US006296502B1

(12) United States Patent
Takata et al.

(10) Patent No.: US 6,296,502 B1
(45) Date of Patent: Oct. 2, 2001

(54) CONNECTOR

(75) Inventors: Kensaku Takata; Katsutoshi Kato, both of Nagoya (JP)

(73) Assignees: Harness Systems Technologies Research, Ltd., Nagoya (JP); Sumitomo Wiring Systems, Ltd., Mie; Sumitomo Electric Industries, Ltd., Osaka ( * ) Notice: Subject to any disclaimer, the term of this patent is extended or adjusted under 35 U.S.C. 154(b) by 0 days.

(21) Appl. No.: 09/624,249

(22) Filed: Jul. 24, 2000

(30) Foreign Application Priority Data

Sep. 27, 1999 (JP) ..... 11-272955
Sep. 30, 1999 (JP) ..... 11-278152
Oct. 5, 1999 (JP) ..... 11-283718

(51) Int. Cl.[7] ..... H01R 13/64
(52) U.S. Cl. ..... 439/248
(58) Field of Search ..... 439/34, 247, 248, 439/374, 527, 576

(56) References Cited

U.S. PATENT DOCUMENTS 5,176,524 * 1/1993 Mizumo et al. ..... 439/68
5,516,300 * 5/1996 Tsuji ..... 439/188
5,663,866 * 9/1997 Ichikawa et al. ..... 361/643
5,771,575 * 6/1998 Onizuka et al. ..... 29/868
5,800,197 * 9/1998 Hyzin ..... 439/372
5,829,910 * 11/1998 Kameyama ..... 403/329
5,997,328 * 12/1999 Kodama et al. ..... 439/247
6,159,019 * 12/2000 Norizuki et al. ..... 439/34

* cited by examiner

*Primary Examiner*—Brian Sircus
*Assistant Examiner*—Thanh-Tam T Le
(74) *Attorney, Agent, or Firm*—Oliff & Berridge, PLC

(57) ABSTRACT

A press protuberance 12*a* for pressing a terminal engagement member 2 is provided on a holder 12. There is provided an insufficient insertion prevention structure 30. According to the insufficient insertion prevention structure 30, when mounts of connectors to be connected are mutually moved, the terminal engagement member 2 is pushed to a predetermined position of a housing 11 of a second connector 10 by means of the press protuberance 12*a* of the holder 12.

5 Claims, 28 Drawing Sheets

CONNECTOR

BACKGROUND OF THE INVENTION

1. Field of the Invention

The present invention relates to a connector used for electrically connecting various electrical-component modules to a panel of a car body.

2. Description of the Related Art

During conventional processes for assembling a meter panel, a door module, an overhead module, or the like, after connectors of a wire harness of a panel of a car body (for example, a dashboard, a door panel, or a roof panel) have been manually coupled to connectors of a wire harness of a panel of an electrical-component module (for example, an instrument panel or an inner panel), a panel of an electrical-component module is attached to the panel of the car body. A necessity for manual coupling of connectors imposes a problem in terms of the ease of assembly. Further, a wire harness of connectors requires slack, and slack in the wire harness may cause unusual noise and raises a possibility that electric wires could be caught during assembly of panels. Preventing such problems has required various countermeasures.

To this end, there have been proposed connectors which can be coupled together simultaneous with attachment of an electrical module to a stationary panel of a car body (see unexamined Japanese Patent publication No. Hei. 5-54933. The sole point of characteristic of this invention is that connectors are mounted on each panel in a longitudinal direction (in a direction in which panels are mutually opposed). A wide connector coupling space must be ensured between panels (i.e., in a depth wise direction of panels).

Moreover, there have been proposed connectors which can be coupled together simultaneous with attachment of an electrical module to a stationary panel of a car body (see unexamined Japanese Patent publication No. Hei. 10-242040).

According to the Japanese publication No. 10-242040, the connectors are embodied by means of a first connector provided on a first mount member and a second connector provided on a second mount member. When the first and second mount members are caused to approach each other, the first connector is connected to the second connector. More specifically, the first connector is mounted on the first mount member while being oriented laterally, and a holder is mounted on the second mount member. The holder supports the second connector so as to be able to deflect in a forward direction while being oriented horizontally. When the first and second mount members are caused to approach each other, the second connector is connected to the first connector while being oriented laterally and deflected in a forward direction.

Specifically, the connectors are embodied by means of a connector (first connector) 304 of an overhead module (e.g., a room lamp) module 303 (shown in FIGS. 26A and 26B) being connected to a connector (second connector) 303 of a roof panel 301 (shown in FIGS. 27A and 27B).

A support base 305 is mounted on the upper surface of the overhead module 303, and an insert shoe groove 305*a* is formed in the support base 305. A shoe 304*b* formed on the bottom of the connector 304 is inserted into the support base 305, and an engagement projection 4*c* of the connector 4 (see FIG. 28A) is engaged with an engagement hole 4*b*. As a result, the connector 304 is fixed on top of the support base 305 while being oriented laterally.

A square-box-shaped holder 306 is attached to the lower surface of the roof panel 301. A guide pin 302*b* of the connector 302 is engaged with and guided by a cam slot 306*a* of the holder 6. An engagement section 302*a* of the connector 302 is engaged with an engagement section 304*a* of the stationary connector 304 while being moved in a forward direction (designated by arrow F) and being oriented laterally.

As shown in FIG. 28A, the holder 306 of the roof panel 301 temporarily holds the connector 302 in an initial position while being oriented laterally, and the connector 304 of the overhead module 303 is secured laterally.

As shown in FIG. 28B, when the overhead module 303 is caused to approach the roof panel 301 in parallel (as designated by arrow A), the engagement section 304*a* of the connector 304 is fitted into the engagement section 302*a* of the connector 302.

When the overhead module 303 is caused to approach the roof panel 301 further, the guide pin 302*b* is guided, as shown in FIG. 29A, by the cam slot 306*a* of the holder 306 and is moved in forward direction F while being oriented laterally. In association with approaching of the overhead module 303 to the roof panel 301, the engagement section 302*a* of the connector 302 is engaged with the engagement section 304*a* of the connector 304, wherewith terminals of the engagement section 302*a* of the connector 302 are connected to terminals of the engagement section 304*a* of the connector 304.

As shown in FIG. 29B, when the overhead module 303 is caused to approach the roof panel 301 to a further extent, the connector 302 is moved further in the forward direction F while being oriented laterally. The engagement section 302*a* of the connector 302 is deeply engaged with the engagement section 304*a* of the connector 304, wherewith terminals of the connector 302 and terminals of the connector 304 are completely connected together. Thus, connection of the connector 304 to the connector 302 is completed.

As mentioned above, if the overhead module 303 is caused to approach the roof panel 301, the engagement section 302*a* of the connector 302 is engaged with the engagement section 304*a* of the connector 304 while being moved in the forward direction F and being oriented laterally. Therefore, the connectors 302 and 304 remain lateral before and after coupling. Thus, there is obviated a necessity for ensuring a wide connector coupling space between the roof panel 301 and the overhead module 303 (in a depth wise direction thereof). The connectors 302 and 304 can be connected even in a narrow depthwise space.

In a connector, a terminal engagement member is usually inserted from one side of a housing, and an electrode terminal housed in a cavity is engaged with the housing.

In a known connector, in the case where a terminal engagement member for engaging an electrode terminal in the housing is inserted to an insufficient extent; in other words, to a predetermined position in the housing, the terminal engagement member fails to engage the electrode terminal in the housing.

Moreover, if relative vertical and/or horizontal positional displacements arise between the connectors 302 and 304, when the connector 302 cannot be smoothly engaged with the connector 304 while the overhead module 303 is being caused to approach the roof panel 301. For this reason, demand exists for the connectors 302 and 304 having self-alignment functions.

Also, in connection with commercialization, this connector construction has room for improvement in terms of ease of assembly.

SUMMARY OF THE INVENTION

The present invention has been conceived to solve such a problem of the related art and, and an object of the invention is to provide a connector which prevents insufficient insertion of a terminal engagement member for engaging an electrode terminal, thereby engaging the electrode terminal in the housing without fail.

According to a first aspect of the invention, there is provided a connector comprising:

a first connector mounted on a first mount, and a second connector mounted on a second mount, in which, when the first and second mounts are caused to approach each other, the first connector is connected to the second connector, the connector comprising:

a holder for sustaining at least one of the first and second connectors;

a terminal engagement member for locking, in a housing, an electrode terminal which is inserted from one side of the housing of the connector and is to be housed in the connector;

a press protuberance provided on a holder for pushing the terminal engagement member; and an insufficient insertion prevention structure for pushing a terminal engagement member in an insufficiently-inserted state to a predetermined position in a housing of the connector, by means of a press protuberance of the holder when the first and second mounts are caused to move relatively.

By means of the foregoing connector construction, when the first and second mounts are caused to move relatively, an insufficient insertion prevention structure pushes a terminal engagement member in an insufficiently-inserted state to a predetermined position in a housing of the connector by means of a press protuberance of a holder. Accordingly, the connector can prevent the terminal engagement member for locking an electrode terminal from entering an insufficiently-inserted state. Thus, the electrode terminal can be locked in a housing without fail.

According to a second aspect of the invention, there is provided a connector comprising:

a first connector mounted on a first mount, a second connector mounted on a second mount, the first connector being connected to the second connector when the first and second mounts are caused to approach each other, the first connector being mounted on the first mount in a laterally-oriented position, a holder mounted on the second mount, and the second connector being supported by the holder in such a manner that the second connector is oriented laterally and can deflect in a forward direction, in which, when the first and second mounts are caused to approach each other, the second connector is connected to the first connector while being oriented laterally and deflected in a forward direction, the connector comprising:

a terminal engagement member for locking, in a housing, an electrode terminal which is inserted from one side of the housing of the second connector and is to be housed in the second connector;

a press protuberance provided on a holder for pushing the terminal engagement member; and an insufficient insertion prevention structure for pushing a terminal engagement member in an insufficiently-inserted state to a predetermined position in a housing of the second connector by means of a press protuberance of the holder when the first and second mounts are caused to move relatively.

Further, the present invention can be applied to a connector which couples a second connector to a first connector while being directed laterally and deflecting in a forward direction. Therefore, there is achieved the same working-effect as that mentioned previously.

According to a third aspect of the invention, there is provided a connector for connecting a first connector to a first mount, comprising:

a terminal engagement member for locking, in a housing, an electrode terminal which is inserted from one side of the housing of the first connector and is to be housed in the first connector;

a press protuberance provided on the first mount for pushing the terminal engagement member; and an insufficient insertion prevention structure for pushing a terminal engagement member in an insufficiently-inserted state to a predetermined position in a housing of the first connector by means of a press protuberance of the first connector when the first connector and the first mount are caused to move relatively When the first connector and the first mount are caused to approach each other, the insufficient insertion prevention structure pushes a terminal engagement member in an insufficiently-inserted state to a predetermined position in the housing of the first connector. As a result, a terminal engagement member for locking an electrode terminal can be prevented from entering an insufficiently-inserted state, thus locking the electrode terminal in the housing without fail.

According to a fourth aspect of the invention, there is provided a connector comprising:

a support base mounted on a first mount member, a first connector which is oriented laterally and is supported by the support base so as to be able to deflect in any of the vertical, horizontal, and back/forth directions, a holder mounted on a second mount member, and a second connector which is supported by the holder while being oriented laterally and can be deflected in a forward direction, wherein when the first and second mount members are caused to approach each other, the second connector is coupled to the first connector while being deflected in a forward direction and oriented laterally, the connector comprising:

a lock section which is formed on the support base and has a lock hole formed therein;

a spring section which is formed in a lower portion of the first connector, is connected at both ends to the first connector, and has a U-shaped shape form when viewed from the top; and a lock piece section which has a lock claw and is formed in the middle of the U-shaped spring section, wherein, when the lock section of the support base is inserted into a clearance between the lower surface of the first connector and the upper surface of the lock piece section, the lock claw of the lock piece section is engaged with the lock hole of the lock section, whereby the first connector is supported so as to be able to deflect while both ends of the U-shaped spring section are taken as fulcrums.

By means of such a connector, the lock section of the support base is inserted into the clearance between the lower surface of the connector and the upper surface of the lock piece, and the lock claw of the lock piece is engaged from below with the lock hole of the lock section. As a result, the support base supports the first connector.

At this time, the lock piece section formed in the middle of the U-shaped spring section of the connector is supported by the lock section of the support base. Therefore, the connector is supported so as to be movable in any of the vertical, horizontal, and back/forth directions while the ends are taken as fulcrums.

Preferably, insert shoe grooves are formed in an upper portion of the support base, and inset shoes are formed in a lower portion of the first connector. When the shoes of the first connector are inserted into the shoe grooves of the support base, the lock claw of the lock piece of the first connector is engaged with the lock hole of the lock section.

Preferably, A recess is formed in the upper surface of the lock section of the support base, and a regulation projection is formed on the lower surface of the first connector. When the lock claw of the lock piece section of the first connector is engaged from below with the lock hole of the lock section of the support base, the regulation projection is loosely engaged from above with the recess. Further, the regulation projection is brought into contact with the interior wall surfaces of the recess, thereby regulating displacement of the first connector.

Preferably, a recess is formed in the lower surface of the first connector, and a regulation projection is formed on the upper surface of the lock piece section of the first connector. When the lock claw of the lock piece section of the first connector is engaged from below with the lock hole of the lock section of the support base, the regulation projection is loosely engaged from below with the recess. Further, the regulation projection is brought into contact with the interior wall surfaces of the recess, thereby regulating displacement of the first connector.

Preferably, the first and second mount members correspond to a stationary panel of a car body and an electrical module. As a result, there is obviated a necessity for manually connecting connectors during the process of assembling an automobile.

According to a fifth aspect of the invention, there is provided a connector including:

a first connector mounted on a first mount member while being oriented in a lateral direction, a holder mounted on a second mount member disposed opposite the first mount member, and a second connector attached to the holder while being oriented in a lateral direction so as to be able to oscillate in a forward direction, wherein, when the first and second mount members are caused to approach each other, the second connector is coupled to the first connector while being oriented in a lateral direction and oscillating in a forward direction, the construction comprising:

an engagement section provided in the holder or the second mount member;

an engagement-receiving section provided in the holder or the second mount member such that the engagement-receiving section can be engaged with the engagement section when the holder is slid in the longitudinal direction of the second mount member;

a lock section formed in either the holder or the second member; and a lock-receiving section formed in the counterpart of the holder or the second member (i.e., the second member of the holder) such that the lock section is engaged with the lock-receiving section when the holder is engaged with the second mount member in such a manner that the lock section can be engaged with the lock-receiving section so as to stop movement of the holder.

According to a sixth aspect of the invention, when a holder is slid in the longitudinal direction of a second mount member, engagement sections are engaged with engagement-receiving sections. Further, a lock section is engaged with a lock-receiving section. Thus, the holder can be attached to the second mount with a single operation, thus improving the ease of assembly of connectors. Moreover, a first connector is mounted on a first mount member while being directed in a lateral orientation (i.e., in the direction orthogonal to the direction in which the first and second mount members are mutually opposed). A holder of the second mount member supports a second connector laterally so that the second connector can oscillate in a forward direction. When the first and second mount members are caused to approach each other, the second connector is connected to the first connector while being oriented laterally and oscillating in a forward direction.

Preferably, the engagement section is formed from a hook, and the engagement-receiving section is formed from a hook insert hole and a groove communicating with the hook insert hole.

According to a seventh aspect of the invention, if the engagement section formed from a hook is slid after having been inserted into the hook insert hole of the engagement-receiving section, the hook is engaged with the hook engagement section of the engagement-receiving section. In this case, the engagement section formed from a hook is formed in the center of either the second mount member of the holder, and the engagement-receiving section, which includes a hook insert hole formed separately from the hook engagement section, is formed in the center of the counterpart. As a result, convenience is afforded. More specifically, in a case where only a hook serving as an engagement section and an engagement-receiving section formed from solely a hook insert hole that is an engagement-receiving section from which the hook insert hole is omitted are formed in respective ends of the second mount member and the holder, the distance over which the hook is to be slid becomes shorter. However, in a case where the engagement section is formed in the center of either the second mount member of the holder and the engagement-receiving section are formed in the center of the counterpart in order to improve the attachment of the holder to the second mount member, the hook engagement section is made long, and the distance over which the hook is to be slid must be made long. Further, limitation is imposed on the degree of freedom of the structure of an area surrounding the region at which the hook is to be slid. In the case of the connector construction in which the engagement-receiving section has a hook insert hole formed separately from the hook engagement section, a hook is inserted into and slid in the hook insert hole, wherewith the hook is readily engaged. Therefore, the ease of operation is improved.

Preferably, the engagement section formed from the hook is formed in the holder, and the engagement-receiving section comprising the hook insert hole and the hook engagement section is formed in the second mount member.

Preferably, an engagement-receiving section, which comprises a hook insert hole and a hook engagement section, can be formed in a second mount member by means of forming holes in the second mount member. A holder has an engagement section and accordingly has a complicated constitution. Since the holder is usually formed by means of molding through use of molds, the only requirement is modification of the design of molds, which does not pose any problem in manufacture of a holder. In contrast, the engagement-receiving section is formed in the holder and the engagement section is formed in the second mount member, requiring formation of holes of different types in the second mount member and bending the second mount member. Strict dimensional accuracy is required, and achievement of machining accuracy is difficult, thus adding to manufacturing costs.

Preferably, a protuberance is formed in the hook such that that the protuberance reaches the groove of the hook engagement section while the hook is inserted into the hook insert hole and such that insertion of the hook into the hook insert hole is blocked when the hook is inserted into the hook insert hole while being oriented in an incorrect direction.

By means of employment of such a construction, if an attempt is made to insert a hook into a hook insert hole while the hook is oriented in an incorrect direction, the protuberance formed in the hook blocks insertion of the hook into the hook insert hole, thus preventing insertion of a hook while the hook is oriented in an incorrect direction.

Preferably, lock release means for releasing the holder from a stopped state is formed in at least either the lock section or the lock-receiving section.

When the lock release means is activated to thereby disengage the lock section from the lock-receiving section; that is, to thereby release the lock section from a locked state, suspension of relative movement between the second mount member and the holder is released, wherewith the second mount member is separated from the holder.

Preferably, detection means for detecting whether or not the holder is attached to the second mount member while being oriented in a specified direction is formed in at least either the second mount member or the holder.

By means of employment of such a construction, if an attempt is made to attach the holder to the second mount member while the second mount member is oriented in an incorrect direction, the detection means makes an operator aware of the holder being oriented in an incorrect direction. As a result, the operator can attach the holder to the second mount member in only a predetermined direction. In a case where the engagement section is engaged with the engagement-receiving section while the engagement section is oriented in a specified direction, such detection means is effective.

Preferably, the detection means is formed on the holder so as to protrude toward the second mount member.

A holder usually formed through use of molds is provided with the detection means. Therefore, even in a case where the structure of the holder becomes complicated, the only requirement is modification of the design of molds, thus posing no problem in manufacture of a holder. This is particularly effective when the engagement section formed from a hook is formed in the holder and the engagement-receiving section formed from a hook insert hole and a hook engagement section is formed in the second mount member.

Preferably, an opening hole is formed in the second mount member for receiving the detection means formed in the holder By means of employment of such a construction, unless the detection means is inserted into the opening hole, a hook cannot be inserted into the hook insert hole. Further, in a state in which a hook is inserted in the hook insert hole, there can be prevented relative rotation between the second mount member and the holder. Moreover, when an opening hole is formed in the second mount member, the hole can be formed by means of drilling the second mount hole, which does not pose any problem in terms of ease of machining. This is particularly effective when the present invention is applied to combination of a construction in which the detection means is formed in the holder so as to protrude toward the second mount member and a construction in which the engagement section formed from a hook is formed in the holder and the engagement-receiving section formed from a hook insert hole and the hook engagement section is formed in the second mount member.

Preferably, the first and second mount members correspond to a stationary panel of a car body and movable panel of an electrical module.

BRIEF DESCRIPTION OF THE DRAWINGS

FIGS. 1A through 1D are front cross-sectional views showing a connector construction according to a first embodiment of the present invention and an operating state of the connector, wherein FIG. 1A shows a state in which a terminal engagement member moves a second connector remaining in an insufficiently-inserted state to a push protuberance formed on a holder, FIG. 1B shows a state in which an end face of the terminal engagement member is caused to approach the press protuberance of the holder, FIG. 1C shows a state in which an end face of the terminal engagement member is pressed against the press protuberance of the holder, and FIG. 1D shows a state in which the terminal engagement member is pushed to a predetermined position in the housing of the second connector by means of the press protuberance of the holder.

FIGS. 2A through 2C are side cross-sectional views showing a connector construction example according to the first embodiment and an operating state of the connector, wherein FIG. 2A shows a state in which a first connector mounted on a first mount and a second connector mounted on a second mount are coupled when they are caused to approach each other, FIG. 2B shows a state in which an end face of the terminal engagement member starts moving toward a press protuberance of a holder, and FIG. 2C shows a state in which the end face of the terminal engagement member is pressed against the press protuberance of the holder by means of separating the mounts from each other, to thereby push the terminal engagement member to a predetermined position in the housing.

FIGS. 3A and 3B are side cross-sectional views showing the connector construction according to the first embodiment and its operating state, wherein FIG. 3A shows a state in which the end face of the terminal engagement member remaining in an insufficiently-inserted state is pressed against the press protuberance of the holder, and FIG. 3B shows a state in which the end face of the terminal engagement member is pressed against the press protuberance of the holder, to thereby push the terminal engagement member to a predetermined position in the housing.

FIGS. 4A through 4C are side cross-sectional views showing an example connector for coupling a first connector to a first mount and the operating state of the connector, wherein FIG. 4A shows a state in which the terminal engagement member couples a first connector remaining in an insufficiently-inserted state to a first mount, FIG. 4B shows a state in which a first mount is slid, inserted into, and caused to approach a mount section of the first connector, to thereby press a tapered tip-end section of the press protuberance against a tapered section of the terminal engagement member, and FIG. 4C shows a state in which a terminal engagement member is pressed to a predetermined position in the housing a first connector by means of a press protuberance of the first mount.

FIGS. 5A and 5B are connectors of an overhead module according to the present invention, wherein FIG. 5A is a perspective view, and FIG. 5B is a fragmentary perspective view showing insert shoes.

FIGS. 9A and 9B show connectors, wherein FIG. 9A is a cross-sectional plan view of a connector, and FIG. 9B is a cross-sectional side view showing a connector before the connector is supported by a support base.

FIGS. 13A and 13B show the connector construction according to the present invention, wherein FIG. 13A is a perspective view showing the assembly of a male connector and a stationary base, and FIG. 13B is an exploded perspective view showing the same.

FIGS. 17A and 17B are illustrations showing connection between connector constructions according to the first embodiment, wherein FIG. 17A is a cross-sectional view showing connectors before coupling, and FIG. 17B is a front cross-sectional view showing the connectors after coupling.

FIGS. 18A and 18B are illustrations showing connection between connector constructions according to the first embodiment, wherein FIG. 18A is a cross-sectional view showing a temporarily-engaged female connector, and FIG. 18B a front cross-sectional view showing the same.

FIGS. 19A and 19B are illustrations showing connection between connector constructions according to the first embodiment, wherein FIG. 19A is a cross-sectional view showing connectors which are in the process of being coupled, and FIG. 19B a front cross-sectional view showing the same.

FIGS. 21A through 21C show a hold guide structure of the connector construction according to the first embodiment, wherein FIG. 21A is an exploded cross-sectional view showing connectors before they are held and guided; and FIGS. 21B and 21C are cross-sectional views showing the connectors which are in the course of being held and guided.

FIGS. 26A and 26B show known connectors, wherein FIG. 26A is a perspective view showing assembly of a connector and a support base, and FIG. 26B is an exploded perspective view showing the connector shown in FIG. 26A.

FIGS. FIGS. 28A and 28B show connection of connectors, wherein FIG. 28A is a cross-sectional view showing the connectors before connection, and FIG. 28B is a cross-sectional view showing a temporarily-engaged connector.

FIGS. 29A and 29B show connection of connectors, wherein FIG. 29A is a cross-sectional view showing connectors which are in the course of being coupled, and FIG. 29B is a cross-sectional view showing connectors after coupling.

DETAILED DESCRIPTION OF THE PRESENT INVENTION

Preferred embodiments of the present invention will be described in detail hereunder by reference to the accompanying drawings.

First Embodiment

FIGS. 1A through 4C show an example connector construction according to a first embodiment of the present invention.

A connector 1 is to electrically connect an electrical-component module, such as an automobile instrument module, a door module, or an overhead module, to a panel 13 of a car body, such as a dashboard, a door panel, or a roof panel.

Figure 2C:
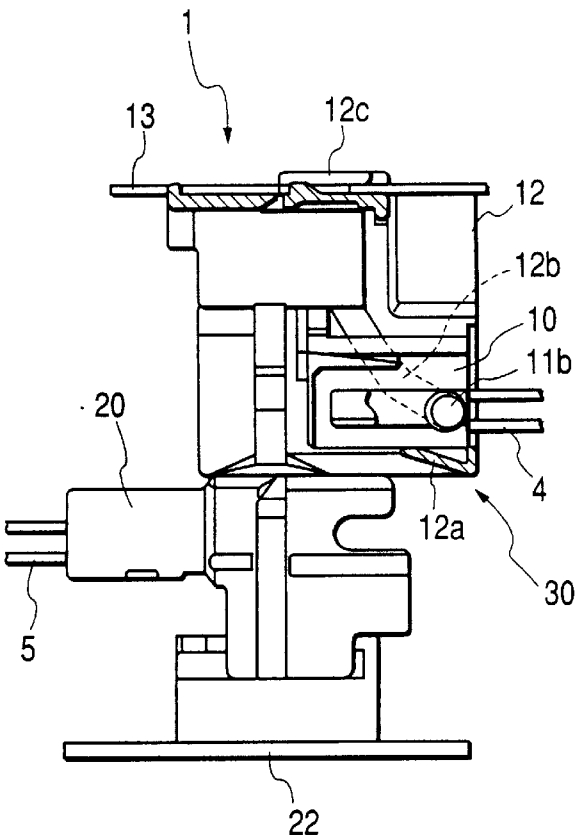
Figure 2B:
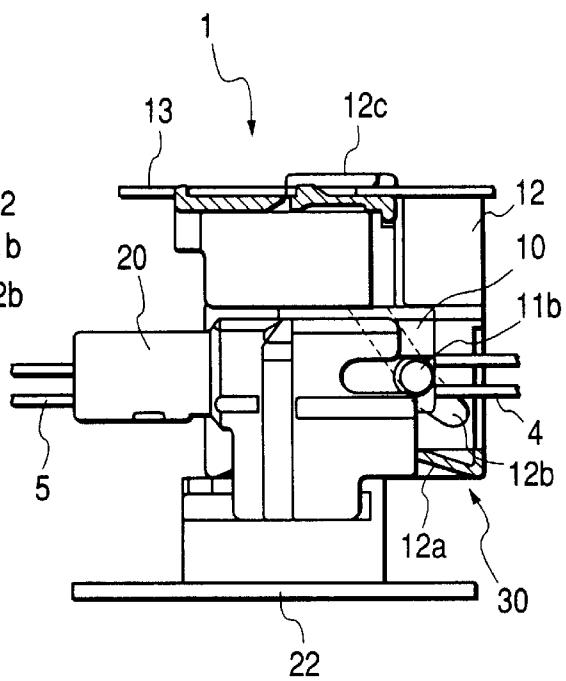
Figure 2A:
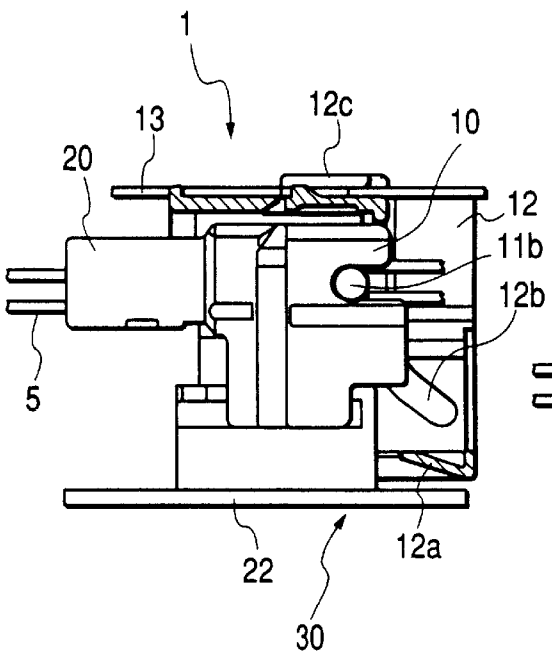

In this connector 1, a first connector 20 is mounted on a first mount 22, and a second connector 10 is mounted on a second mount 13. The first connector 20 and the second connector 10 are coupled together by means of causing the first and second mounts 22 and 13 to approach each other. More specifically, the first connector 20 is mounted on the first mount 22 in a laterally-oriented position, and a holder 12 is fixed on the second mount 13 by means of an engagement section 12*c*. The second connector 10 is supported by the holder 12 in a laterally-oriented position so as to be able to deflect in a forward direction. As shown in FIGS. 2A through 2C, when the first and second mount members 22 and 13 are caused to approach each other, the second connector 10 is connected to the first connector 20 while being oriented laterally and deflected in a forward direction. In the illustrated example, the first connector 20 corresponds to a male connector, and the second connector 10 corresponds to a female connector. The present invention is not limited to such an example. As a matter of course, the first connector 20 may correspond to a female connector, and the second connector 10 may correspond to a male connector.

More specifically, a guide pin 11*b* of the second connector 10 is engagingly supported by a cam slot 12*b* of the holder 12 in such a way that the guide pin 11*b* is oriented laterally and movable in a forward direction. As shown in FIG. 2B, when the first and second mounts 22 and 13 are caused to approach each other, the second connector 10 is moved forward while remaining laterally oriented by means of the cam slot 12*b*. As shown in FIG. 12A, terminals of the first connector 20 and terminals of the second connector 10 are completely engaged with each other.

Figure 3B:
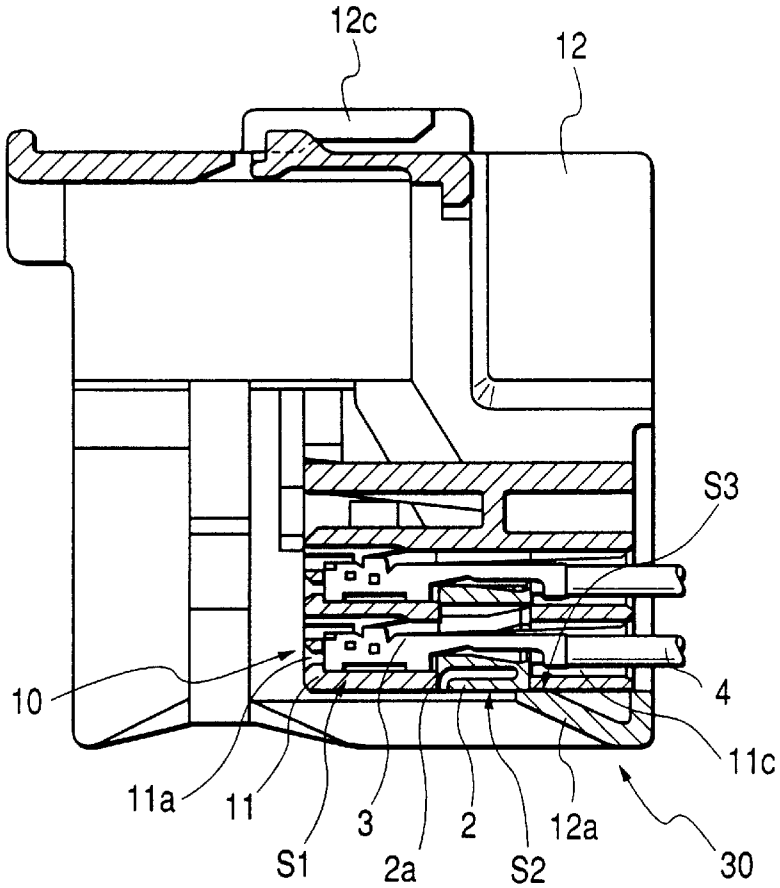

As shown in FIG. 3B, an electrode terminal 3 connected to an electric cable 4 by means of crimping is housed in a cavity 11*c* of the second connector 10. The electrode terminal 3 is locked in a position which is in communication with a male terminal insert hole 11a of the housing 11, by means of a lock piece 2*a* of the terminal engagement member 2 inserted into the housing 11 from a lower surface S1.

However, in a case where the terminal engagement member 2 is not fully inserted to a predetermined position in the housing 11, an end face S2 of the terminal engagement member 2 protrudes from the lower surface S1 of the second connector 10. In such a state, the tip end of the lock piece 2*a* is in contact with the interior wall surface of the housing 11, and hence the electrode terminal 3 housed in the cavity 11*c* cannot be locked.

In order to prevent insufficient insertion of the terminal engagement member 2, the connector 1 according to the present invention is provided with an insufficient-insertion prevention structure 30.

Figure 1A:
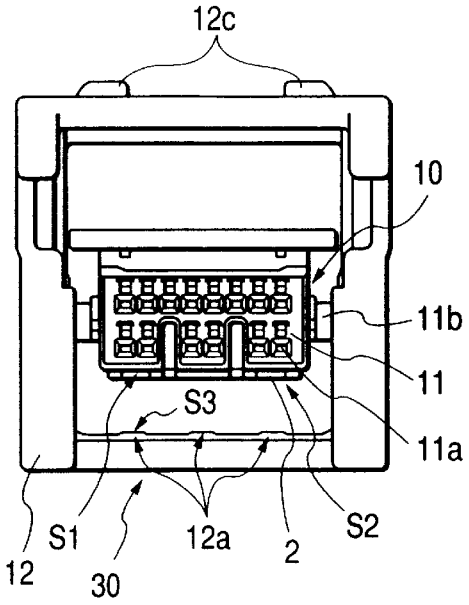
Figure 1B:
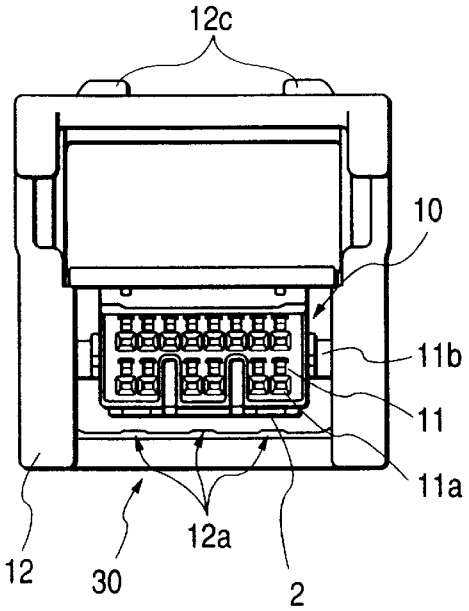
Figure 1C:
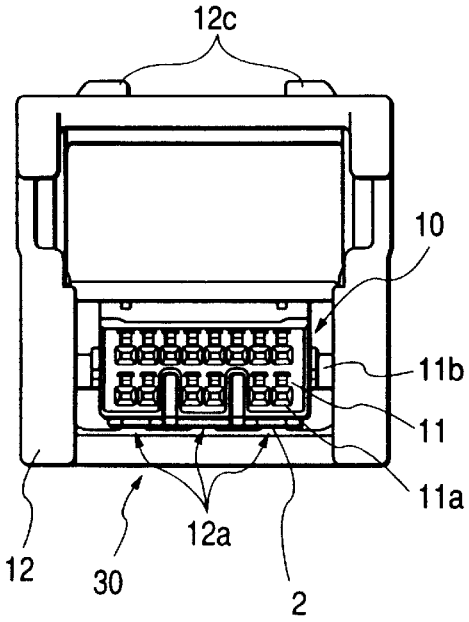
Figure 1D:
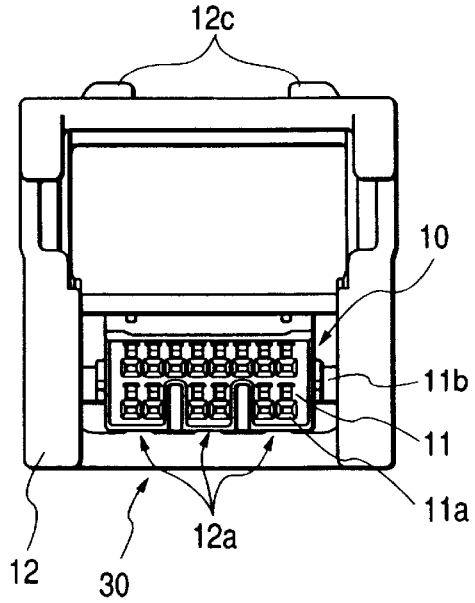
Figure 3A:
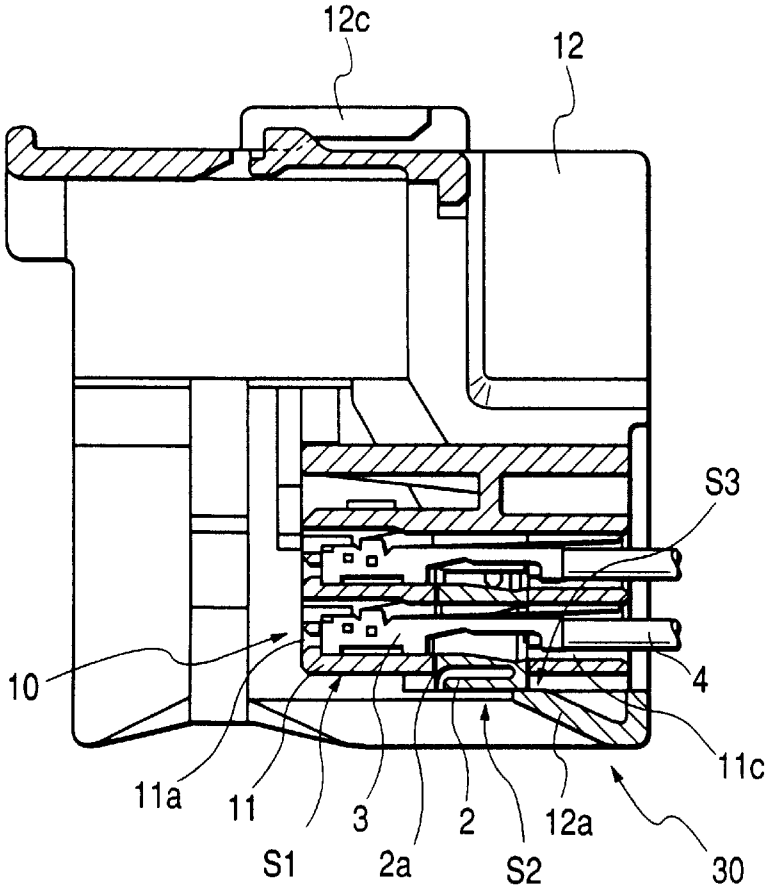

The insufficient insertion prevention structure 30 is provided with a press projection 12*a* for pressing the terminal engagement member 2 into the space defined by the interior walls of the holder 12. When the first and second mounts 22 and 13 are separated from each other, as shown in FIG. 2C, the first and second mounts 22 and 13 are fully separated from each other while a tip end S3 of the press projection 12*a* of the holder 12 is pressed against an end face S2 of the terminal engagement member 2, as shown in FIGS. 1C and 3A. As a result, the terminal engagement member 2 is pushed to a predetermined position in the housing 11 of the second connector 2 by means of the press projection 12*a* of the holder 12, as shown in FIGS. 1D and 3B.

Accordingly, the connector can prevent insufficient insertion of the terminal engagement member 2 for locking the electrode terminal 3, thereby enabling the terminal engagement member 2 to lock the electrode terminal 3 without fail.

Second Embodiment

Figure 4A:
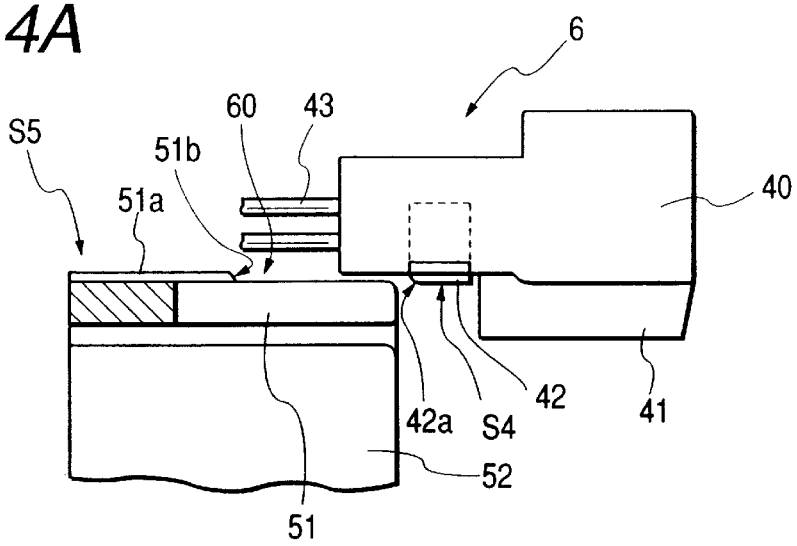
Figure 4B:
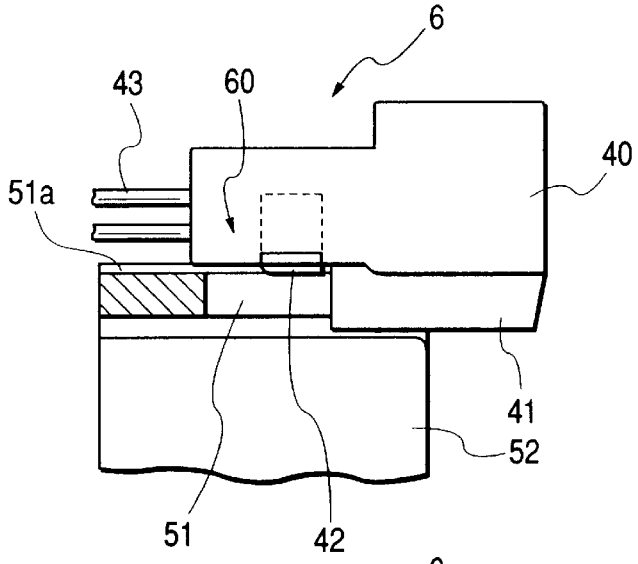
Figure 4C:
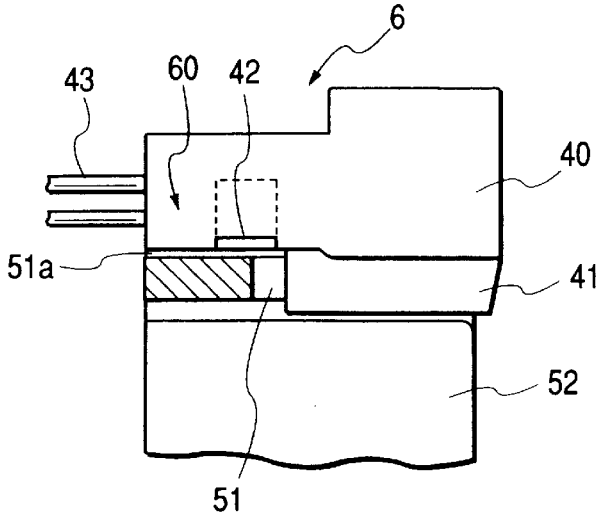

FIGS. 4A through 4C show an example construction of a connector 6 according to a second embodiment of the present invention.

In the connector 6, a first connector 40 is attached to a mount 41, and a first mount member 51 is attached to an electrical-component module unit case 52. For example, guide ribs formed in the first mount member 51 are guided by and slid into guide grooves formed in the mount 41, wherewith the mount 41 is connected to the first mount member 51. An electrode terminal (not shown) to be connected to an electric cable 43 is housed in a housing of the first connector 40. The electrode terminal is locked in a housing, by means of a terminal engagement member 42 for inserting the electrode terminal from one side of the housing of the first connector 40. The first mount member 51 is provided with a push protuberance 51*a* for pushing the terminal engagement member 42. Further, the connector 6 is equipped with an insufficient-insertion prevention structure 60. According to the insufficient-insertion prevention structure 60, when the first connector 40 and the first mount member 51 are caused to approach each other, the terminal engagement member 42 remaining in an insufficiently-inserted state is pushed to a predetermined position in the housing of the first connector 40, by means of the push protuberance 51*a* of the first mount member 51.

As shown in FIG. 4A, in a case where the terminal engagement member 42 is in an insufficiently-inserted state in which the terminal engagement member 42 protrudes downward from a lower surface of the first connector 40, according to the insufficient insertion prevention structure 60 the first mount member 51 is slid and inserted into the mount 41 of the first connector 40. When the first mount member 51 and the mount 41 are caused to approach each other, a tapered tip end 51*b* of the push protuberance 51 comes into contact with a tapered section 42*a* of the terminal engagement member 42. When the first mount member 51 and the mount 41 are caused to approach further, the terminal engagement member 42 is raised by the tapered tip end 51*b* of the push protuberance 51*a*. As shown in FIG. 4C, an end face S4 of the terminal engagement member 42 which is in a semi-inserted state is pushed against an upper surface S5 of the push protuberance 51*a*, as shown in FIG. 4C. As a result, the terminal engagement member 42 is pushed to a predetermined position in the housing of the first connector 40.

Thus, the insufficient insertion prevention structure 60 can prevent the terminal engagement member 42 for locking an electrode terminal from being insufficiently inserted. Hence, the terminal engagement member 42 can lock an electrode terminal in the housing of the first connector 40 without fail.

The connector according to the present invention is not limited to specific constructions described in connection with the embodiments. Needless to say, the connector construction is susceptible to modification, addition, or deletion, as required.

For example, the first embodiment illustrates an example in which the insufficient insertion prevention structure 30 of the connector 1 is configured in such a manner that, when the first and second mounts 22 and 13 are separated from each other, the terminal engagement member 2 is pushed to a predetermined position in the housing 11 of the second connector 10 by means of the press protuberance 12*a* of the holder 12. The present invention is not limited to such an embodiment. The insufficient insertion prevention structure 30 may be configured in such a way as to act when the first and second mounts 22 and 13 are caused to approach each other.

In a case where the connector construction according to the second embodiment is applied to a structure for attaching the first connector 20 shown in FIG. 2 to a mount section of the first mount 22, both the first connector 20 and the second connector 10 can prevent the terminal engagement member 2 from entering an insufficiently-inserted state.

Third Embodiment

FIGS. 5 through 10 show a third embodiment in which a connector (a first connector) 114 of an overhead module (a first mount member; that is, a panel of an electrical module)

103 is connected to a connector 102 (a first connector) of a roof panel (a second mount member; that is, a panel of a car body) 101.

Figure 7:
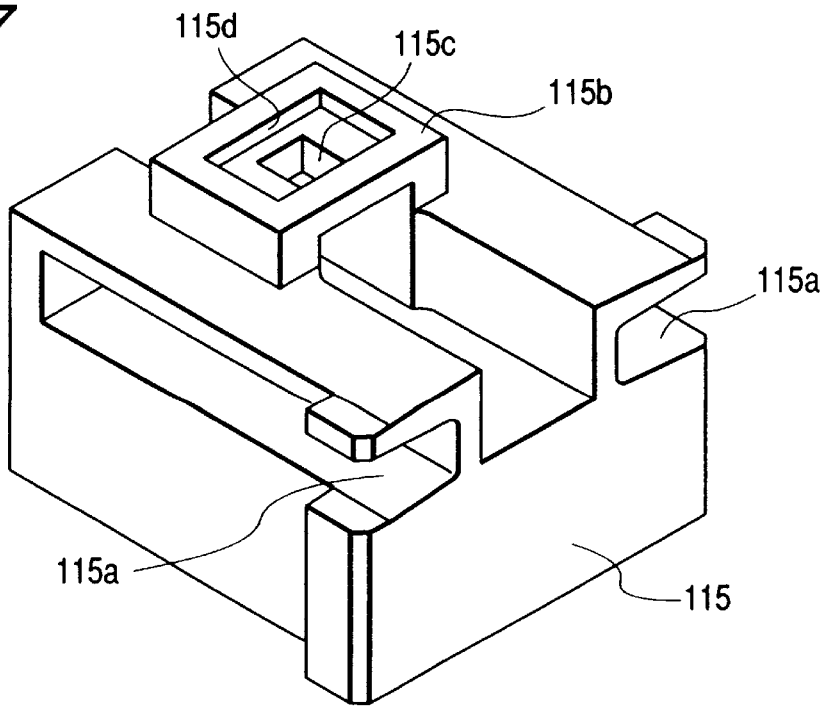
FIG. 7 is a perspective view showing a support base.
Figure 8:
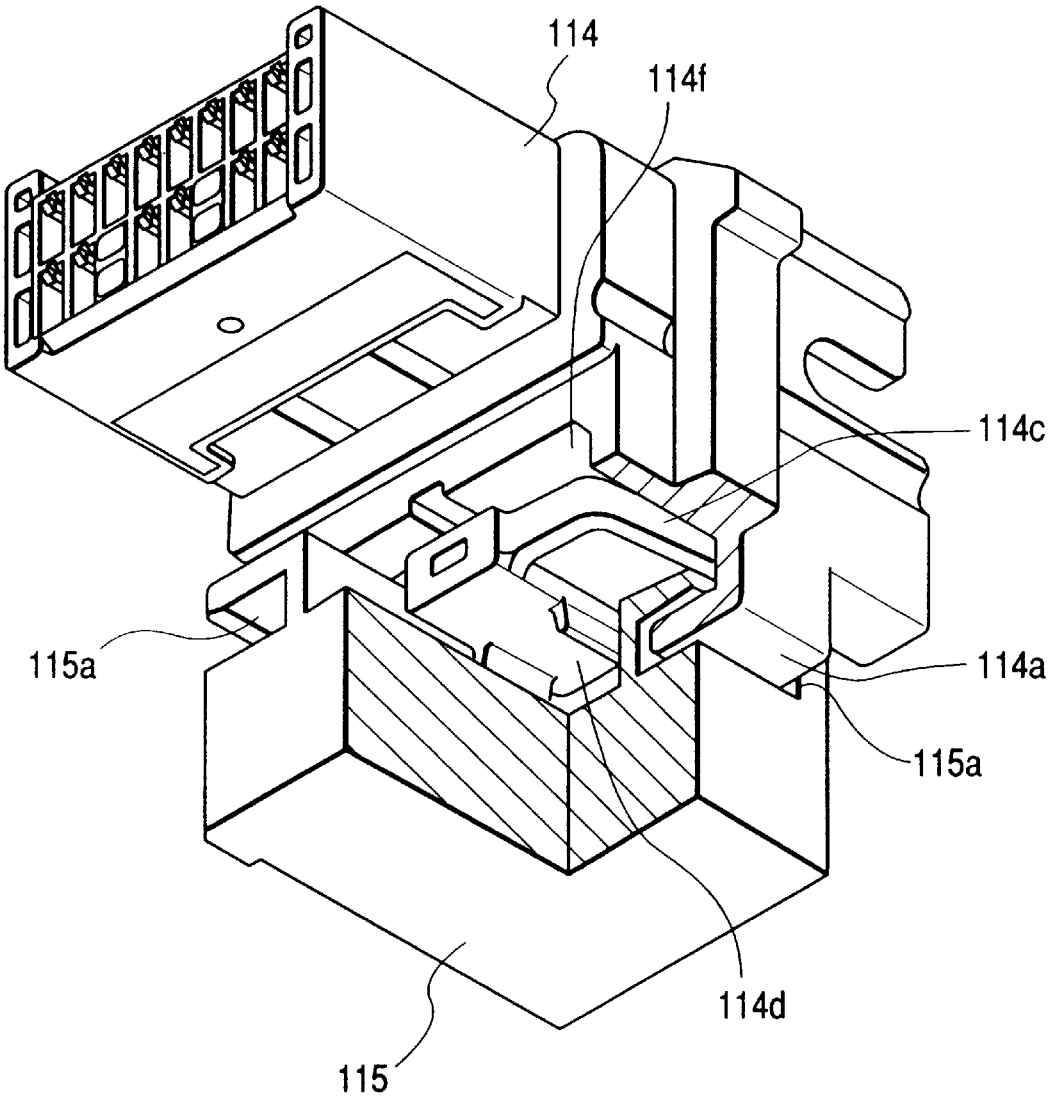
FIG. 8 is a cutaway perspective view showing a connector supported by a support base.

A support base 115 is mounted on the top of the overhead module 103. As shown in FIG. 7, an insert shoe groove 115*a* is formed in an upper portion on either side of the support base 115.

A square lock section 115*b* is integrally formed in an upper portion of the support base 115 so as to straddle the insert shoe grooves 115*a*. A lock hole 115*c* is formed in the center of the lock section 115 so as to penetrate through the support base 115. Further, a square recess 115*d* is formed in the top surface of the lock section 115*a* of the support base 115.

Figure 5A:
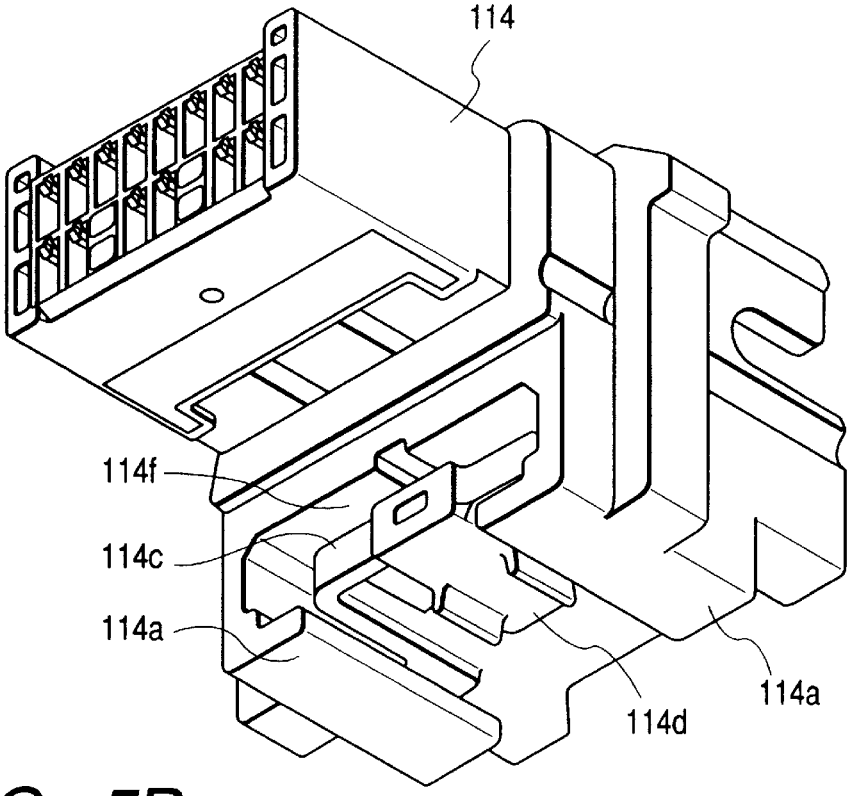
Figure 5B:
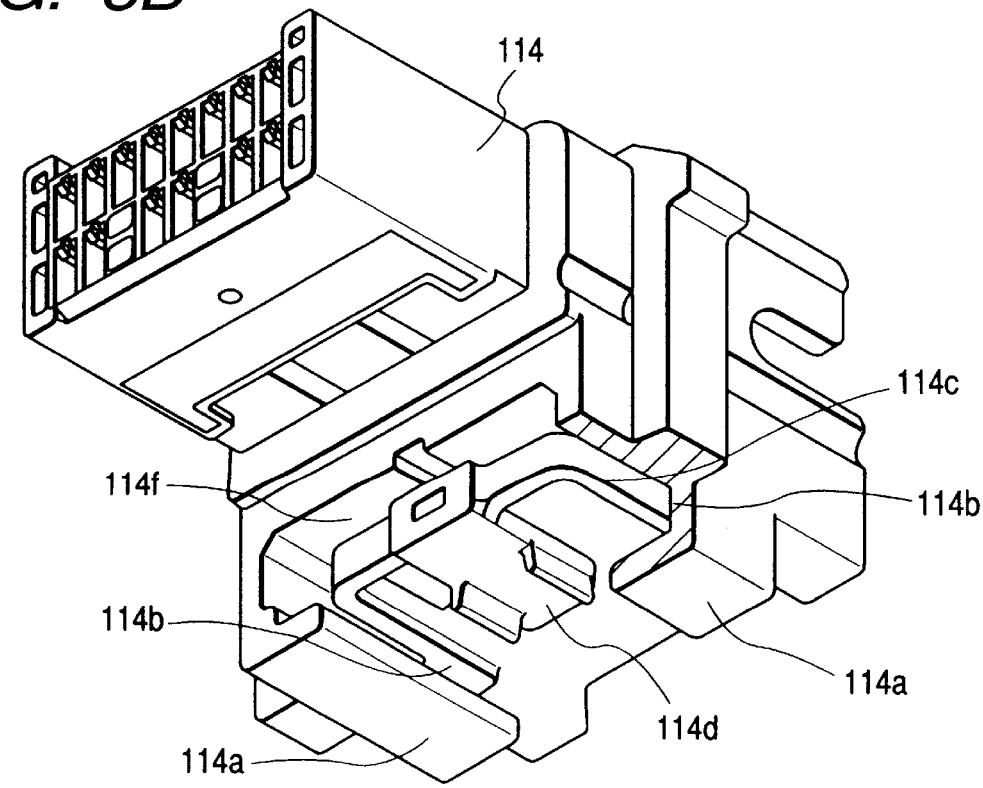
Figure 6:
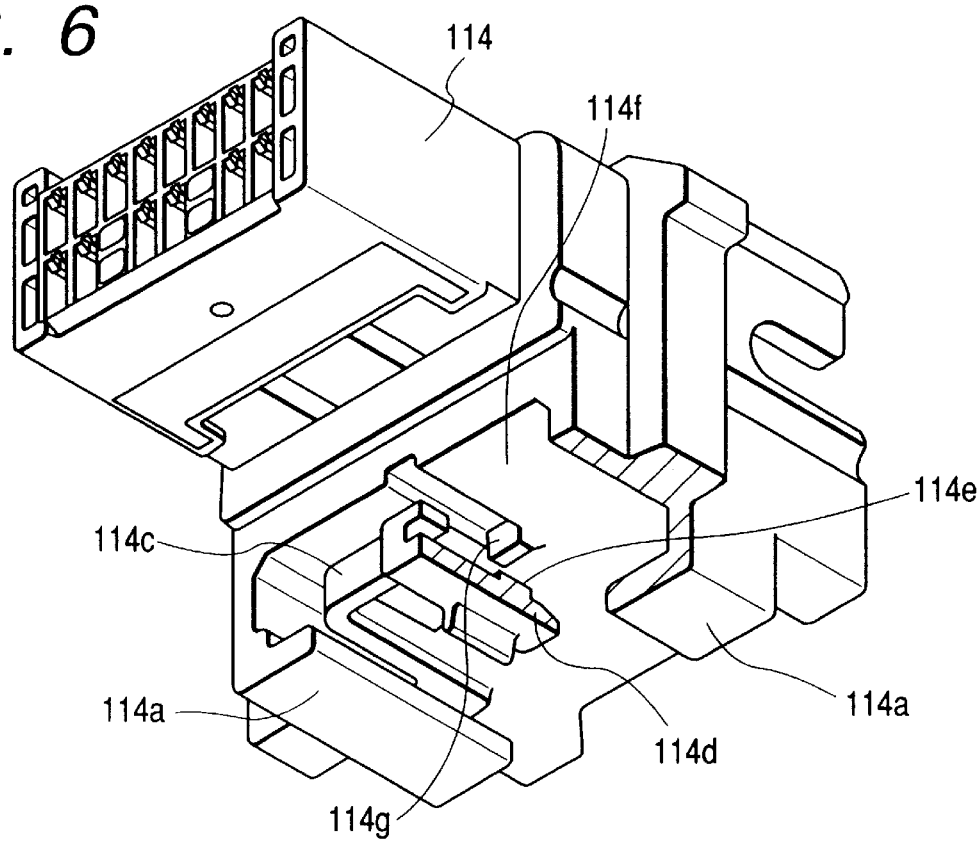
FIG. 6 is a perspective cutaway view of the connector shown in FIGS. 5A and 5B, showing insert shoes and a U-shaped spring section.

As shown in FIGS. 5A through 6, an insert shoe 114*a* which can be inserted into the insert shoe groove 115*a* of the support base 115 is formed on either side of the lower surface of a plastic connector 114.

Figure 9A:
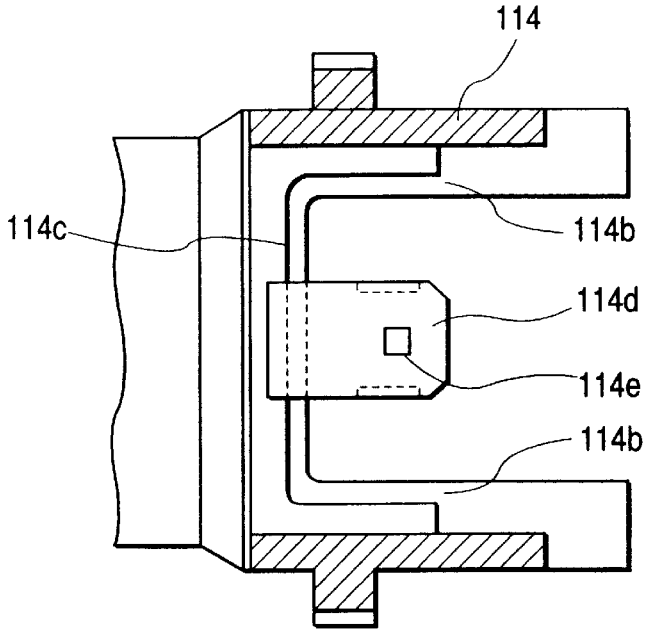

As shown in FIG. 9A, a spring section 114*c* which has a U-shape when viewed from the top is integrally formed with a lower portion of the connector 114 between the insert shoes 114*a*. Respective ends 114*b* of the spring section 114*c* are attached to the connector 114. Since only the respective ends 114*b* of the U-shaped spring section 114*c* are connected to the connector 114, the other portions of the connector 114 are movable. Therefore, the U-shaped spring section 114*c* can be moved in any of the vertical, horizontal, and back/forth directions while the ends 114*b* are taken as fulcrums.

A lock piece section 114*d* is integrally formed in the middle of the U-shaped spring section 114*c* so as to protrude in an opening of the U-shaped spring section 114*c*. A lock claw 114*e* is integrally formed in the upper surface of the lock piece section 114*d* so as to protrude upward. Further, a displacement regulation projection 114*g* is integrally formed on a lower surface 114*f* of the connector 114 opposite the lock claw 114*e*.

Figure 9B:
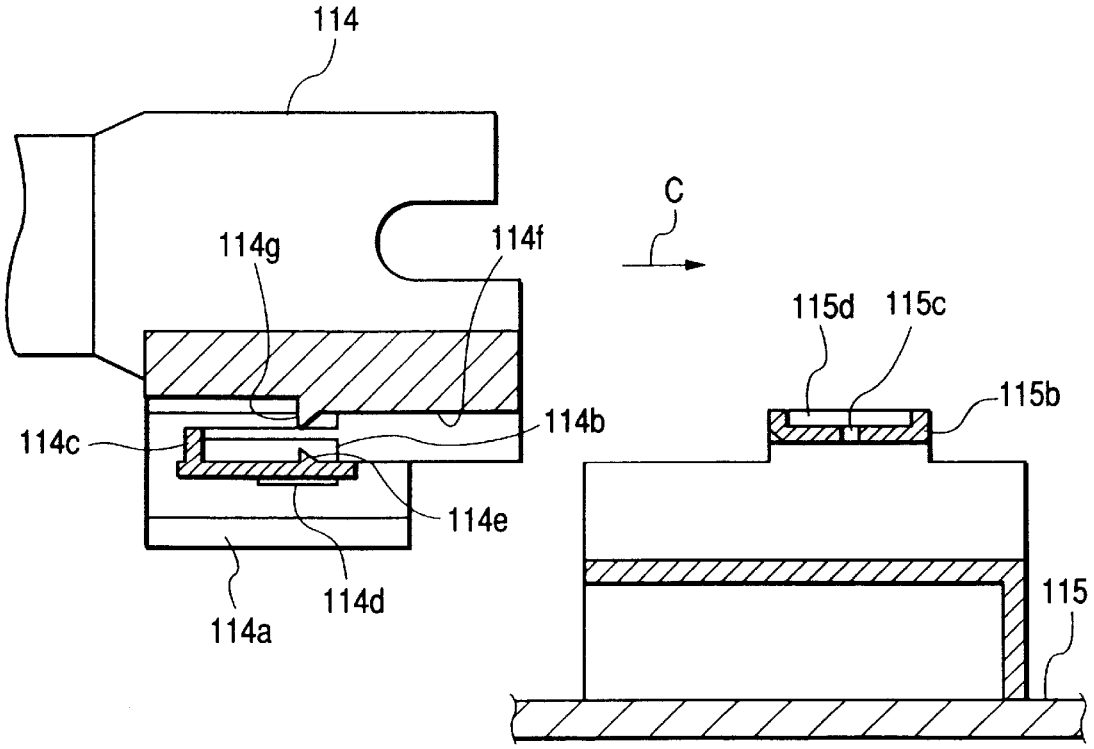
Figure 10:
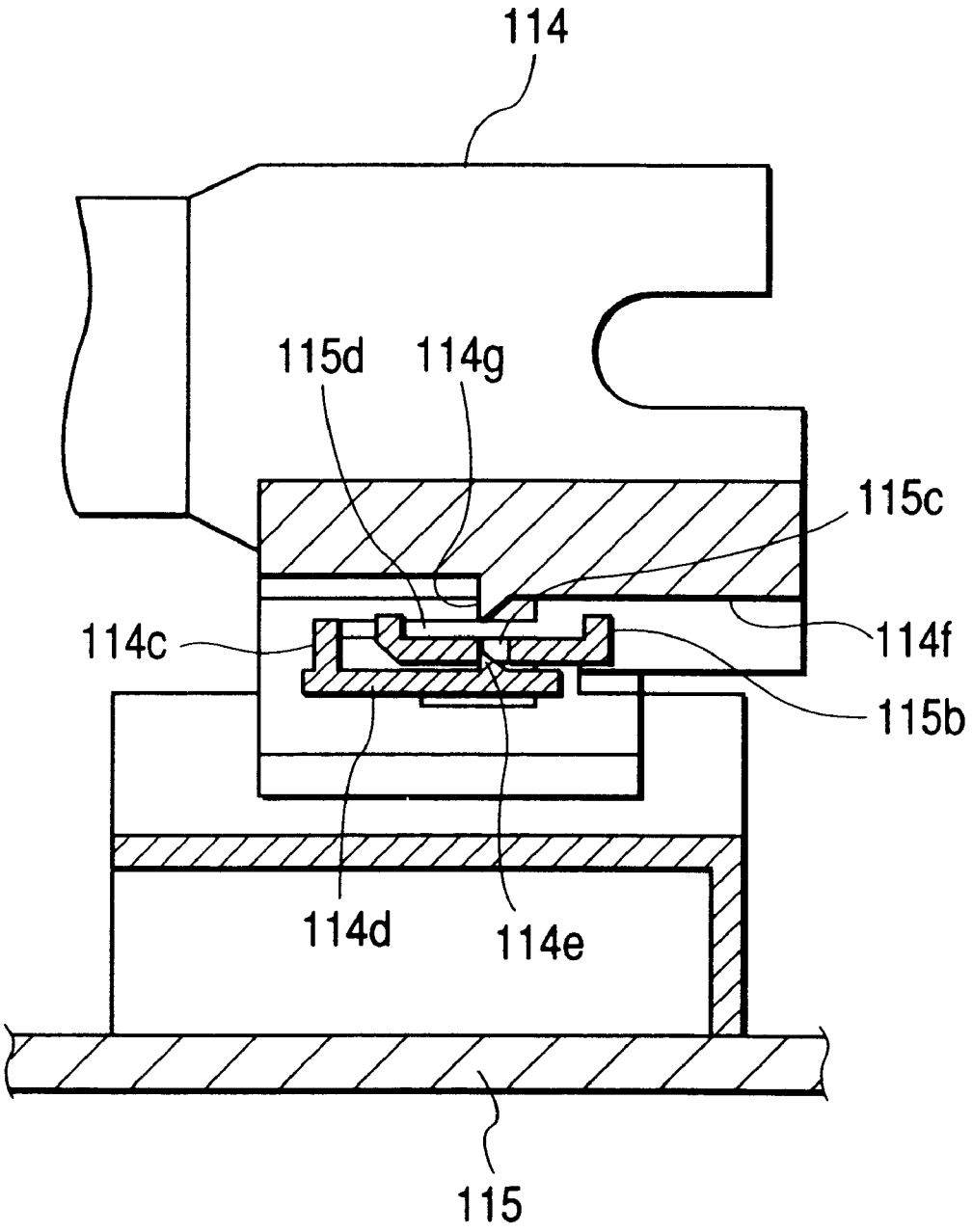
FIG. 10 is a side cross-sectional view showing a connector after the connector has bee supported by the support base.

The insert shoes 114*a* of the connector 114 are inserted into the corresponding inset shoe grooves 115*a* of the support base 115 from the state shown in FIG. 9B, as indicated by arrow C. As shown in FIG. 10, the lock section 115*b* is inserted into a clearance between the upper surface of the lock piece section 114*d* of the U-shaped spring section 114*c* of the connector 114 and the lower surface 114*f* of the connector 114. The lock claw 114*e* of the lock piece section 114*d* is engaged from below with the lock hole 115*c* of the lock section 115*b* of the support base 115. As a result, the connector 114 is supported by the support base 115 while being oriented laterally. At this time, the displacement regulation projection 114*g* is loosely engaged from above with the recess 115*d* of the lock section 115*b*.

In the connector construction set forth, if the lock section 115*b* of the support base 115 is inserted into the clearance between the lower surface 114*f* of the connector 114 and the upper surface of the lock piece 114*d*, the lock claw 114*e* of the lock piece 114*d* is engaged from below with the lock hole 115*c* of the lock section 115*b*. As a result, the support base 115 supports the first connector 114.

At this time, the lock piece section 114*d* formed in the middle of the U-shaped spring section 114*c* of the connector 114 is supported by the lock section 115*b* of the support base 115. Therefore, the connector 114 is supported so as to be movable in any of the vertical, horizontal, and back/forth directions while the ends 114*b* are taken as fulcrums.

Consequently, since the connector 114 has a self-alignment function which enables displacement with respect to the connector 102 in any of the vertical, horizontal, and back/forth direction, the connector 114 of the overhead module 103 can be smoothly connected to the connector 2 of the roof panel 101.

When the insert shoes 114*a* of the connector 114 are inserted into the insert shoe grooves 115*a* of the support base 115, the lock claw 114*e* of the lock piece section 114*d* of the connector 114 is engaged with the lock hole 115*c* of the lock section 115*b* of the support base 115. Hence, the connector 114 can be quickly connected to the support base 115 with a single operation.

When the lock claw 114*e* of the lock piece section 114*d* of the connector 114 is engaged from below with the lock hole 115*c* of the lock section 115*b* of the support base 115, the regulation projection 114*g* is loosely engaged from above with the recess 115*d* of the lock section 115*b*. Hence, the regulation projection 114*g* is brought into contact with the interior wall surfaces of the recess 115*d* of the lock section 115*b*, thereby regulating displacement of the connector 114.

In the event that an operator erroneously and forcefully pulls backward electric wires of the connector 114 during an assembly operation, the U-shaped spring section 114*c* may be extended and broken. Even in such a case, the regulation projection 114*g* of the connector 114 is brought into contact with the interior wall surfaces of the recess 115*d* of the lock section 115*b* of the support base 115, thereby regulating displacement of the connector 114. Therefore, there can be prevented fracture of the U-shaped spring section 114*c*, which would otherwise be caused when the U-shaped spring section 114*c* is extended undesirably.

Figure 11:
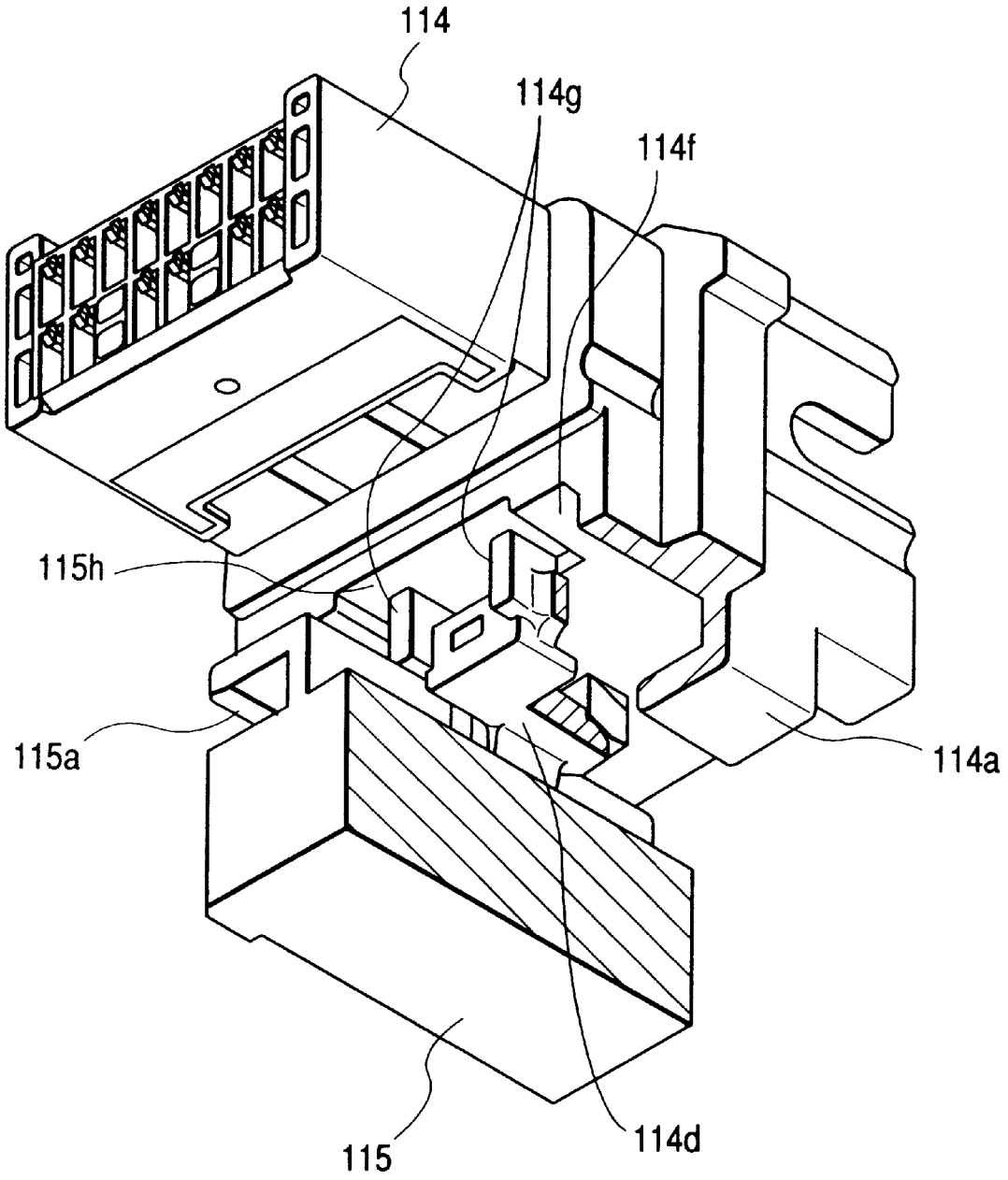
FIG. 11 is a fragmentary perspective view showing a modification of the connector when the connector is supported by the support base.

In the embodiment, the regulation projection 114*g* formed on the lower surface 114*f* of the connector 114 is loosely engaged with.the recess 115*d* of the lock section 115*b* of the support base 115. However, as shown in FIG. 11, a recess 114*h* may be formed on the lower surface 114*f* of the connector 114, and the regulation projection 114*g* may be formed on the upper surface of the lock piece 114*d* of the connector 114 such that the regulation projection 114*g* is loosely engaged from below with the recess 114*h*. The regulation projection 114*g* is brought into contact with the interior wall surfaces of the recess 114*h*, thereby regulating displacement of the connector 114.

In the embodiment, the overhead module 103 is mounted on the roof panel 101. However, the present invention is not limited to such an embodiment. Needless to say, the present invention can be applied to an instrument panel, a door module, a center cluster module, or the like.

Fourth Embodiment

Figure 12:
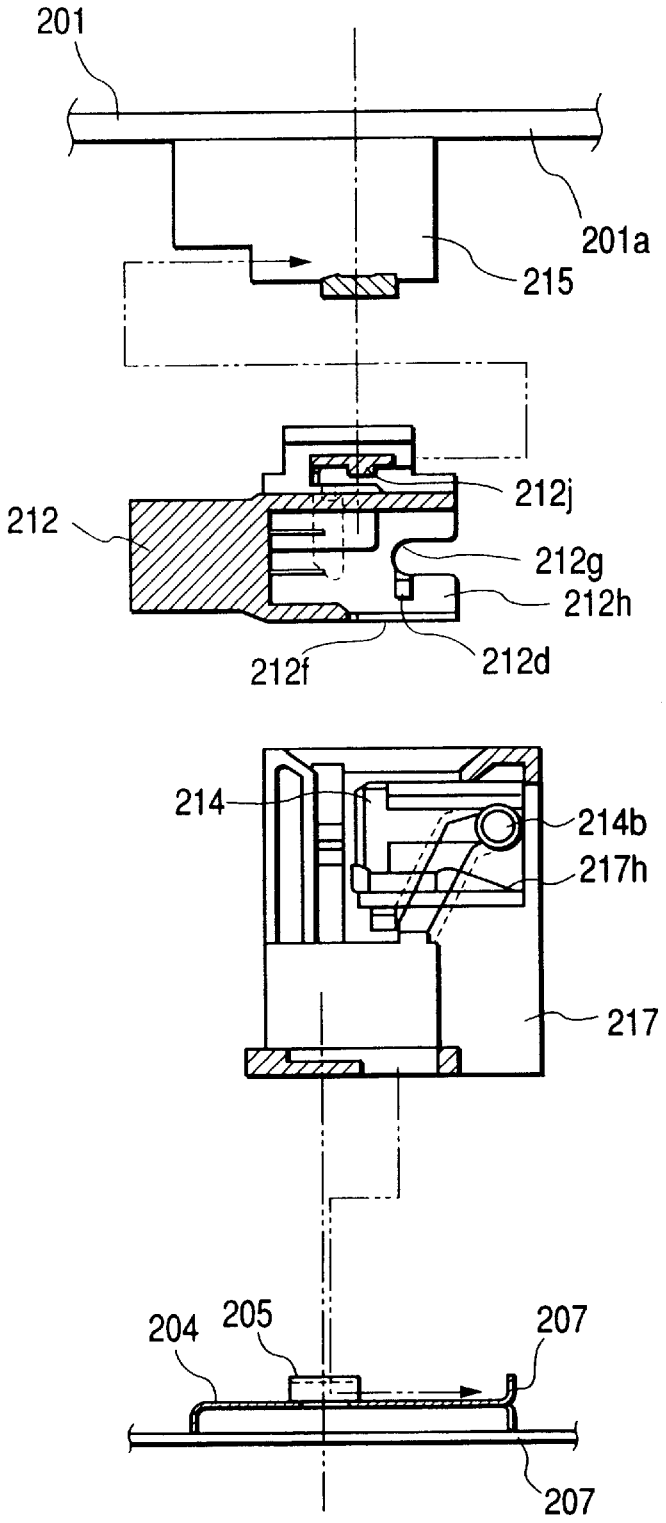
FIG. 12 is an exploded side view showing a connector construction according to a first embodiment of the present invention.

FIG. 12 shows a fourth embodiment in which a male connector (first connector) 212 of an overhead module (first mount member, that is, a panel of an electrical component) 201 is coupled to a female connector (second connector) 214 of a roof panel (second mount member; that, is a panel of a car body) 203. In the present embodiment, the overhead module 201 is shown at an upper position in the drawing, and the roof panel 203 is shown at a lower position in the drawing.

Figure 13A:
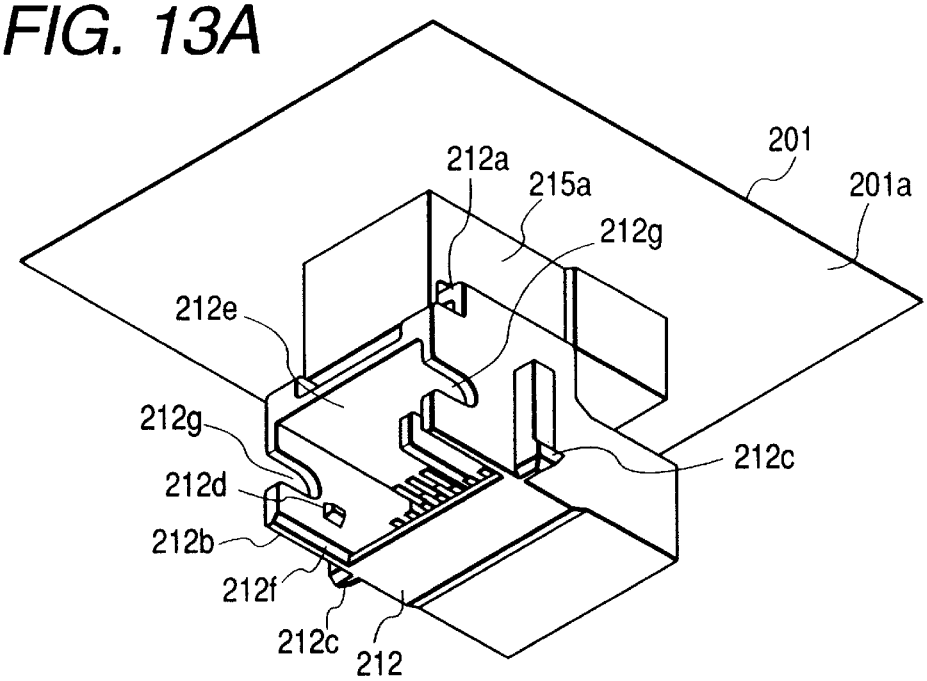
Figure 13B:
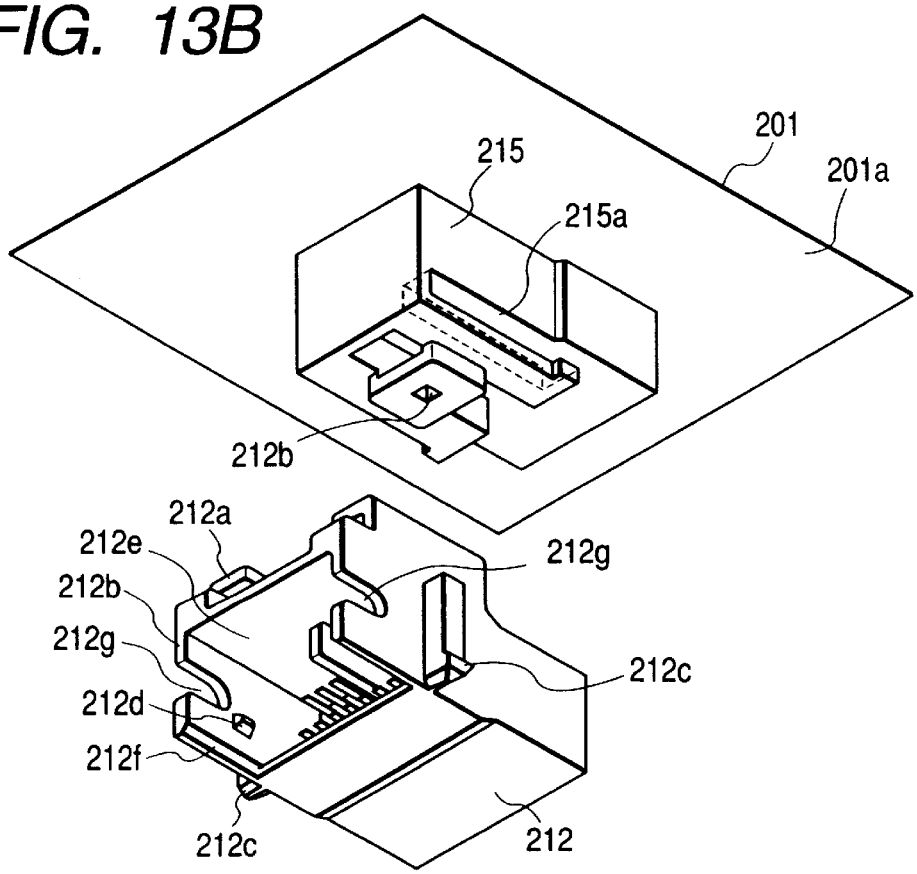

As shown in detail in FIGS. 13A and 13B, a stationary base 215 having an insert shoe groove 215*a* formed therein is attached to an interior surface 201*a* of the overhead module 201, and a shoe 212*a* formed at the bottom of the male connector 212 is inserted into the stationary base 215. An engagement projection 212*j* of the male connector 212 is engaged with an engagement hole 215*b*, wherewith the male connector 212 is fixed on the stationary base 215 while being oriented in a lateral direction.

A narrow clearance is left between the shoe groove 215*a* of the stationary base 215 and the shoe 212*a* of the male connector 212 in the forward/backward and right/left directions. By means of the clearance, the male connector 212 is secured on the stationary base 215 so as to be able to oscillate.

A temporary-engagement release protuberance 212*c* is formed on the exterior surface on either side of a fitting section 212*b* of the male connector 212. Further, a hold guide protuberance 212*d* is formed on the interior surface on either side of the fitting section 212*b* of the male connector 212. In combination with the hold guide protuberance 212*d*, an interior upper surface 212e of the fitting section 212*b* constitutes a hold guide section.

A cutout 212*f* is formed in a lower surface of the fitting section 212*b* of the male connector 212. A fitting section 214*a* of the female connector 214, which will be described later, is fitted into the cutout 212*f* from below. A clearance groove 212*g* is formed in respective side surfaces of the fitting section 212*b* for receiving a guide pin 214*b*, which will be described later.

Figure 14A:
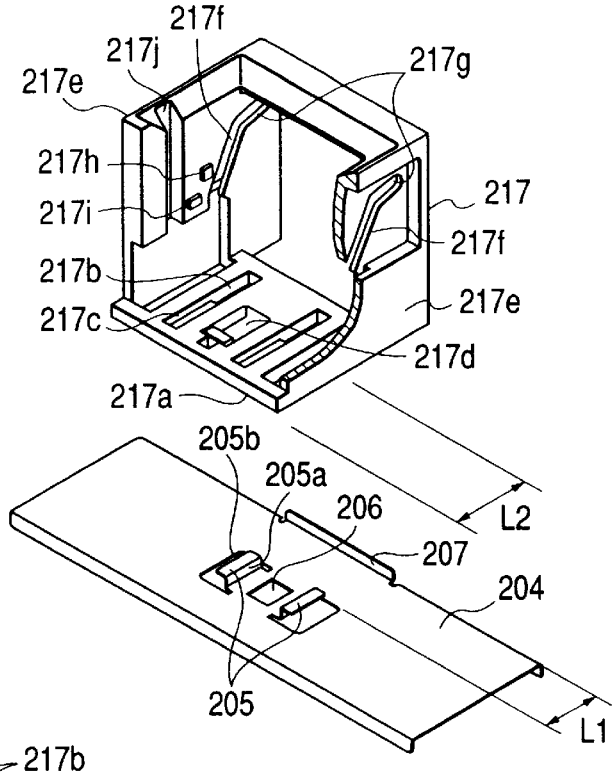
FIGS. 14A through 14C are illustrations (perspective views) showing processes of attaching a female holder to a mount of the connector construction according to the first embodiment.
Figure 14B:
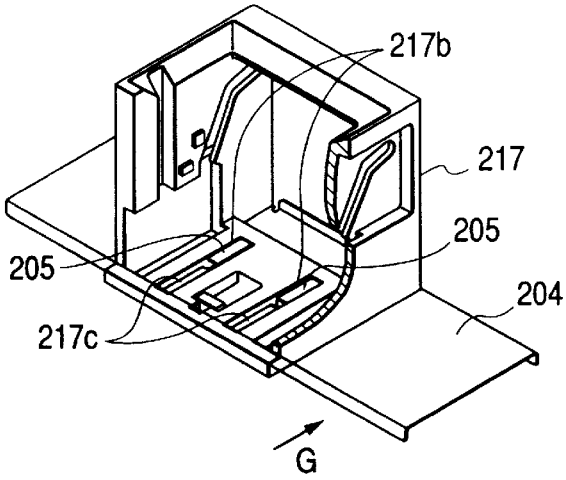
Figure 14C:
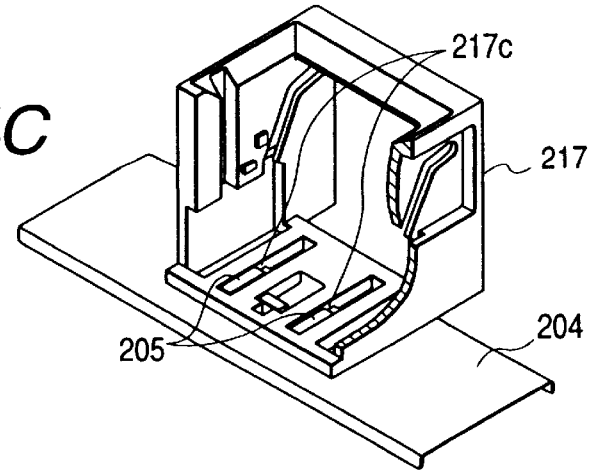

As shown in FIGS. 14A through 14C, a mount 204 which constitutes a part of the roof panel 203 is fastened to the interior surface of the roof panel 203. A pair of engagement sections; for example, hooks 205, are formed in the mount 204. Each of the hooks 205 comprises a raised portion 205*a* and a horizontal section 205*b*. A lock hole 206 is formed between the hooks 205. The lock hole 206 may be either a through hole or recessed.

A female holder 217 assuming a square box shape has an open top surface, and an opening is formed in each of front and back surfaces. A pair of hook insert holes 217*b*, a pair of hook engagement sections 217*c*, and a lock section 217*d* are formed in the bottom surface 217*a* of the female holder 217. As shown in FIG. 14B, the hook 205 is inserted into the hook engagement section 217*c* by way of the hook insert hole 217*b*, and the female holder 217 is slid in a forward direction (designated by arrow G). As shown in FIG. 14C, the horizontal section 205*b* of the hook 205 is engaged with the hook engagement section 217*c*. A groove (not shown) into which the raised section 205*a* is to be inserted is formed in the area of the hook engagement section 217*c*, which area is close to the hook engagement section 217*c* Specifically, the hook engagement section 217*c* has a groove which is in communication with the hook insert hole 217*b*.

Figure 15A:
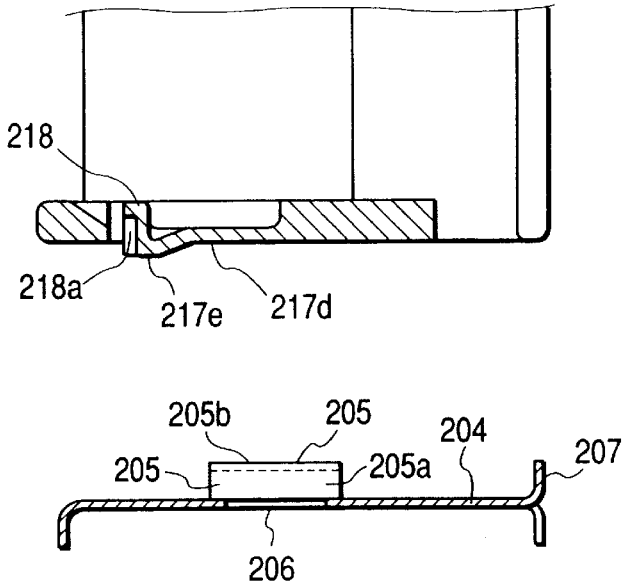
FIGS. 15A through 15*c* are illustrations (front cross-sectional views) showing processes for engaging the lock section in a lock hole of the connector construction according to the first embodiment.
Figure 15B:
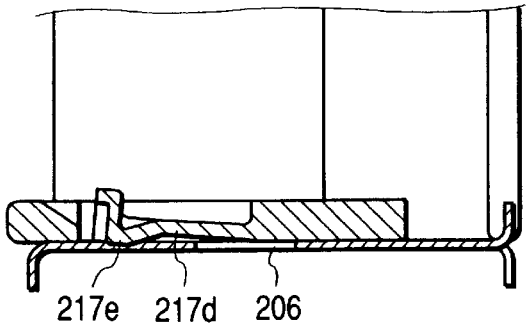
Figure 15C:
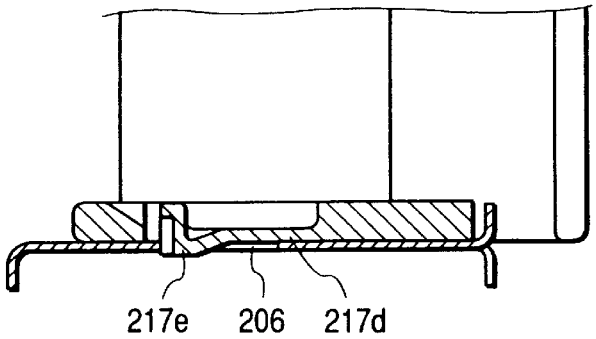

As shown in FIGS. 15A through 15C, the lock section 217*d* is formed into a tongue shape; specifically, respective sides of the lock section 217*d* and the longitudinal end opposite the forward direction (designated by arrow G) are cut. Further, a protuberance 217*e* protrudes from the lock section 217*d* in a downward direction in FIG. 15A. When the hooks 205 are engaged with the hook engagement sections 217*c*, the lock section 217*d* is engaged with the lock hole 206. FIGS. 15A through 15*c* show a change in the state of the lock section 217*d*.

The hooks 205 shown in FIG. 15A are inserted into the hook insert holes 217*b*, as shown in FIG. 15B. Since the protuberance 217*e* of the lock section 217*d* is not situated in a position where the lock hole 206 is present, the protuberance 217*e* is not engaged with the lock hole 206. Subsequently, the female holder 217 is slid in a forward direction (designated by arrow G), wherewith the protuberance 217*e* is engaged with the lock hole 206, as shown in FIG. 15C. In the event of an attempt being made to attach the female holder 217 in an orientation differing from that shown in FIGS. 14A through 14C, detection means 207, which protrudes upward in FIGS. 14A through 14C and detects attachment of the female holder 217 in an incorrect orientation, hinders attachment of the female holder 217. More specifically, distance L1 from the hooks 205 to the detection means 207 is shorter than distance L2 from the hook insert holes 217*b* to the end of the bottom surface 217*a* of the female holder 217 opposite a forward direction (designated by arrow G). Accordingly, the hooks 205 are not inserted into the hook insert holes 217*b*, whereby an operator becomes aware that he is attempting to attach the female holder 217 in an incorrect orientation. Upon being aware that he is attempting to attach the female holder 217 in an incorrect orientation, the operator attempts to disengage and attach the female holder 217 in a correct orientation. As shown in FIG. 15A, lock release means 218 having a recess 218*a* is formed in the tip end of the lock section 217*d*. A pulling tool (not shown) whose tip end is formed into a hook is engaged with the recess 218*a* of the lock release means 218. The lock release means 218 is pulled upward, to thereby release the protuberance 217*e* from the lock hole 206. The lock release means 218 may be embodied by means of causing a portion of the surrounding area of the lock hole 206 of the mount 204 shown in FIG. 15A to extend to a location below the protuberance 217*e*, and the thus-extended portion may be pulled upward through use of a similar pulling tool.

Figure 16:
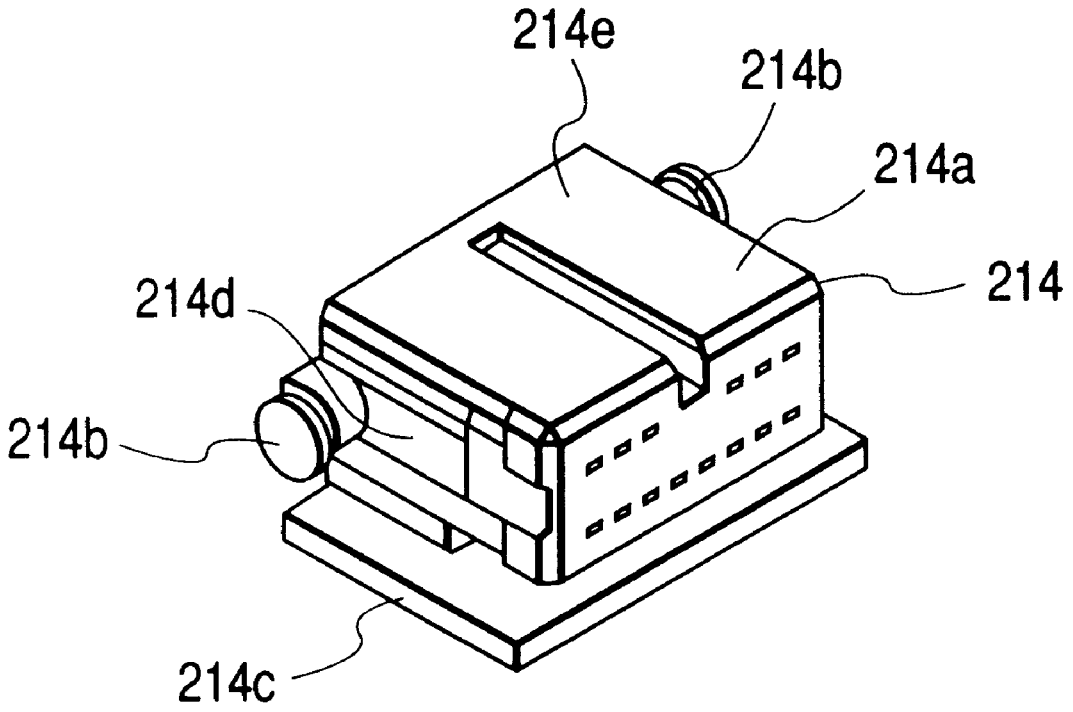
FIG. 16 is a perspective appearance showing a female connector of the connector construction of the first embodiment.

As shown in FIG. 16, the guide pin 214*b* protrudes sideward from respective exterior side surfaces of the fitting section 214*a* of the female connector 214. As shown in FIG. 14A, a cam slot 217*f* tapered down in the direction opposite the forward direction (designated by arrow G) is formed in respective side section 217*e*' of the female holder 217. An upper portion 217*g* of the cam slot 217*f* is tapered slightly downwardly. The guide pin 214*b* of the female connector 214 is fitted into the cam slot 217*f*. As will be described later, the fitting section 214*a* of the female connector 214 is coupled to the fitting section 212*b* of the male connector 212 which is secured stationary and oriented in a lateral direction.

An upper engagement protuberance 217*h* and a lower temporary engagement protuberance 217*i* are formed on the interior surface of respective side 217*e*' of the female holder 217. While the guide pins 214*b* of the female connector 214 are engaged with upper portions 217*g* of cam slots 217*f*, a lower flange 214*c* of the female connector 214 is caught between the upper engagement protuberance 217*h* and the temporary engagement protuberance 217*i*. As a result, the female connector 214 is temporarily engaged in an initial lateral position (see FIGS. 17A and 17B).

An engagement groove 217*j* is formed in a position on the interior surface of respective side 217*e*' of the female holder 217, the position being close to a front opening. When the male connector 212 approaches the upper opening of the female holder 217, the temporary engagement release protuberance 212*c* of the male connector 212 is fitted into the engagement groove 217*j*. As shown in FIG. 17B, a temporary engagement release protuberance 217*k* is formed in a position on the bottom between the engagement protuberance 217*h* of the engagement groove 217*j* and the temporary engagement protuberance 217*i*.

Figure 21A:
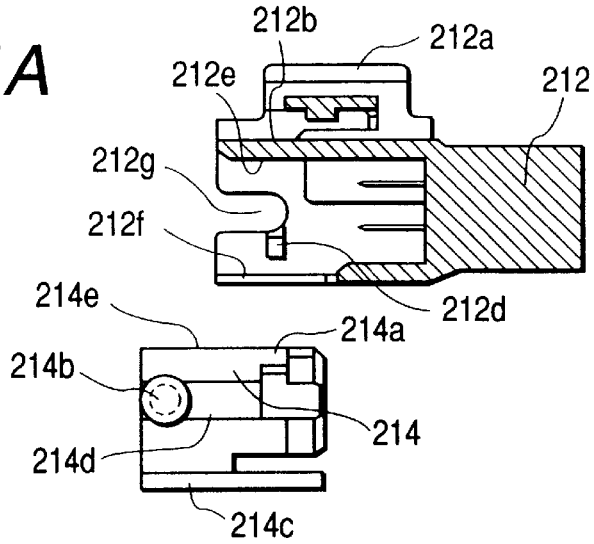
Figure 21B:
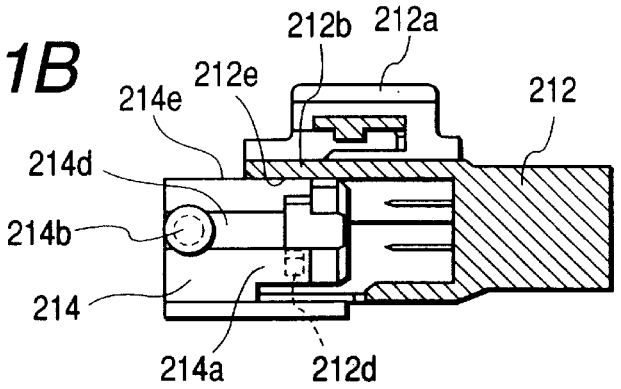
Figure 21C:
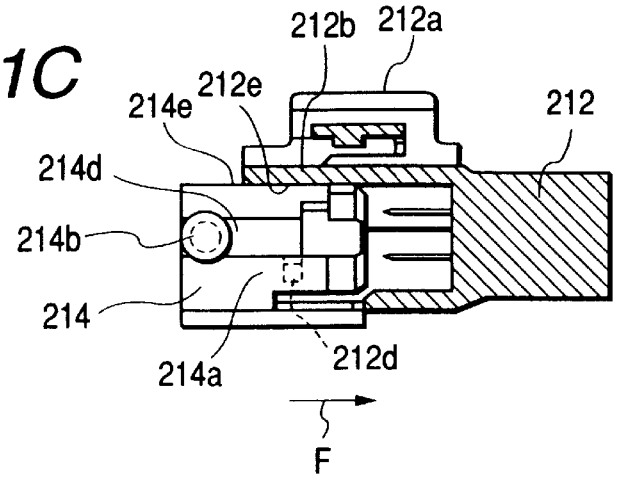

As shown in detail in FIGS. 21A through 21C, a guide rail section 214*d* is formed on the exterior surface of respective side of the engagement section 214*a* of the female connector 214. When the hold guide protuberance 212*d* of the male connector 212 is engaged with the lower end of the hold guide rail section 214*d*, the male connector 212 is engaged (or locked) so as not to move in an engaging direction (i.e., a vertical direction) relative to the female connector 214. At this time, the interior upper surface 212*e* of the engagement section 212*b* of the male connector 212 is brought into contact with the upper surface 214*e* of the engagement section 214*a* of the female connector 214.

Procedures for connecting the male connector 212 to the female connector 214 will now be described.

Figure 17A:
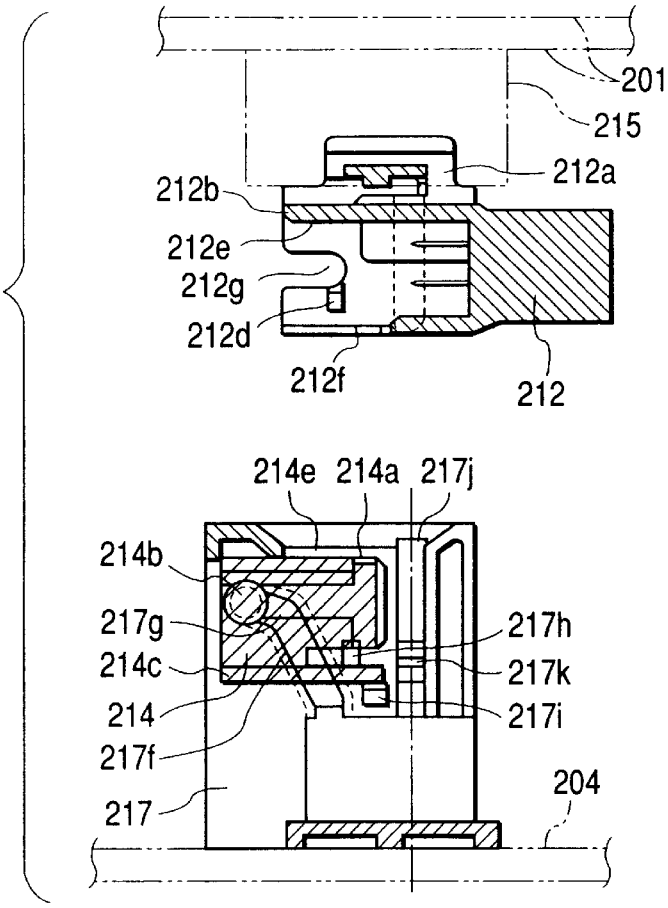
Figure 17B:
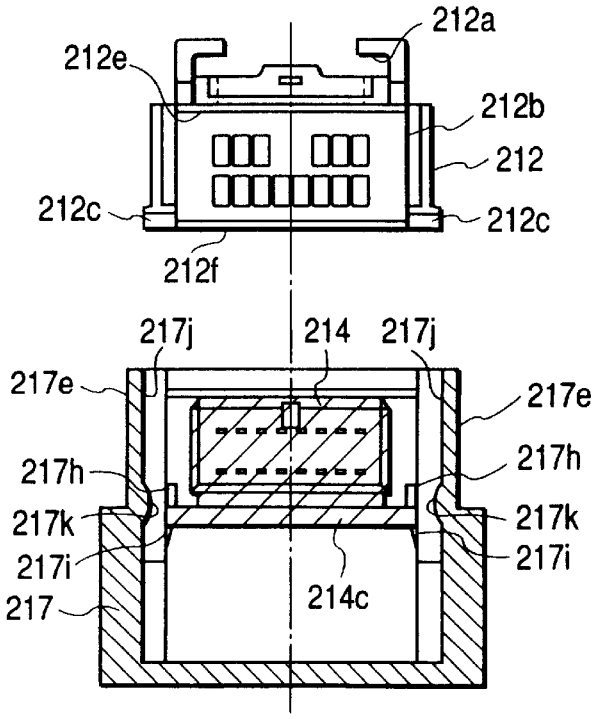

As shown in FIGS. 17A and 17B, the male connector 212 is laterally fixed on the stationary base 215 of the overhead module 201 before coupling (assembly). The female connector 214 of the roof panel 203 is temporarily and laterally engaged with the female holder 217 in an initial position. More specifically, while the guide pin 214*b* of the female connector 214 is engaged with the upper portion 217*g* of the cam slot 217*f* of the female holder 217, the lower flange 214*c* of the female connector 214 is locked in a position between the engagement protuberance 217*h* and the temporary engagement protuberance 217*i*.

Figure 18A:
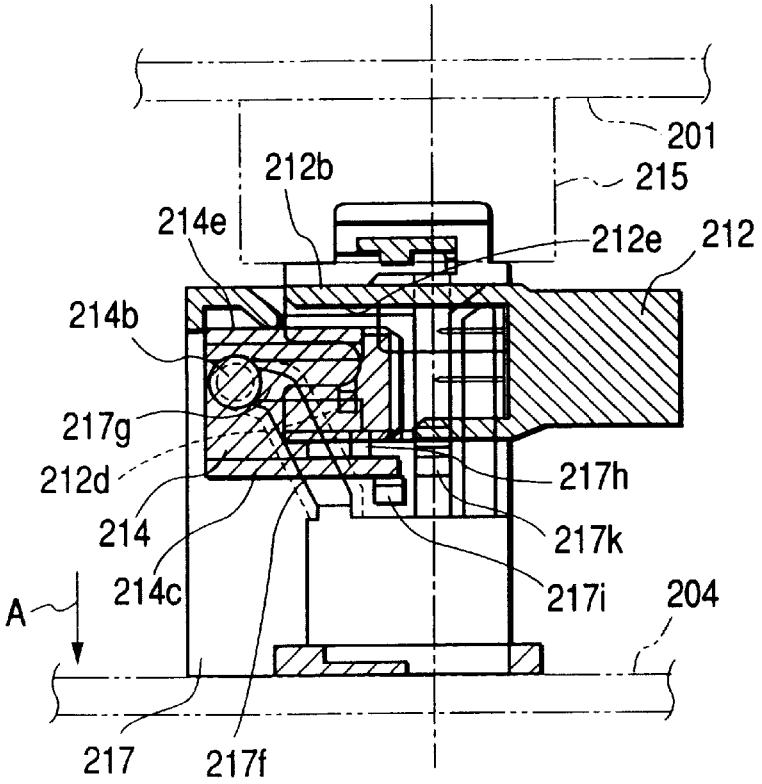
Figure 18B:
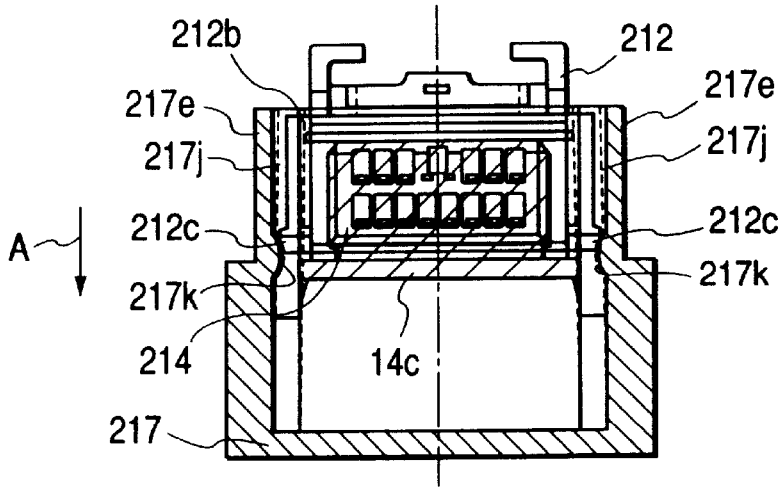

As shown in FIGS. 18A and 18B, the overhead module 201 approaches in parallel with the roof panel 203 (in the direction designated by arrow A), the temporary engagement release protuberance 212*c* of the male connector 212 fits into the engagement groove 217*j* of the female holder 217, and the cutout 212*f* of the engagement section 212*b* of the male connector 212 is engaged with the engagement section 214*a* of the female connector 214. In this state, terminals provided in the engagement section 212*b* and terminals provided in the engagement section 214*a* are in a state immediately preceding an engaged state.

At this time, the temporary engagement release protuberance 212*c* of the male connector 212 sits astride and runs on the temporary engagement release protuberance 217*k* of the engagement groove 217*j* of the female holder 217, thereby pressing the temporary engagement release protuberance 217*k* outward. In association, the sides 217*e*' are bulged outward from the state designated by broken lines to the state designated by solid lines. As a result, the temporary engagement protuberance 217*i* is moved outward, thereby releasing the lower flange 214*c* of the female connector 214 from a temporarily-engaged state or bringing the lower flange 214*c* into a nearly-released state.

Figure 19A:
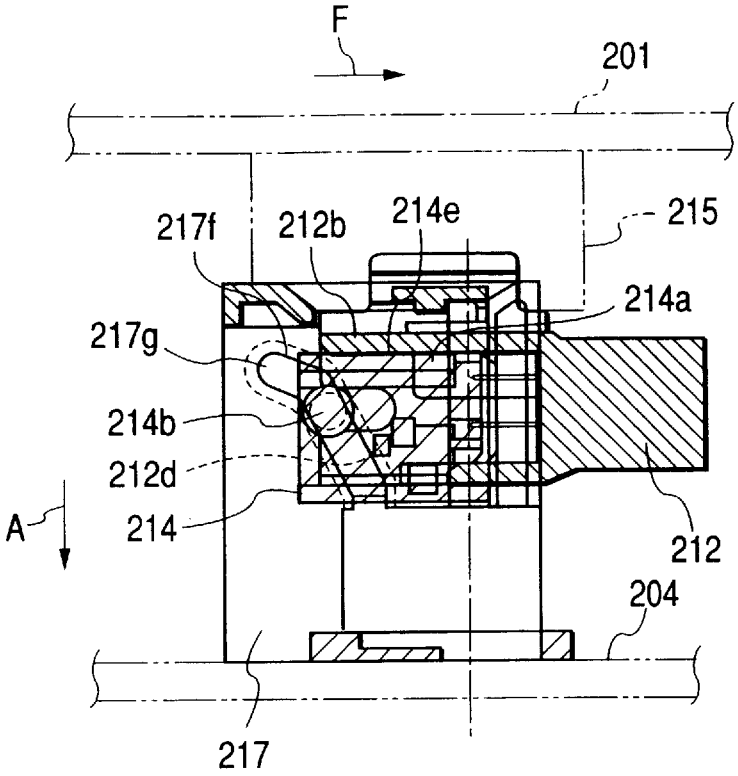
Figure 19B:
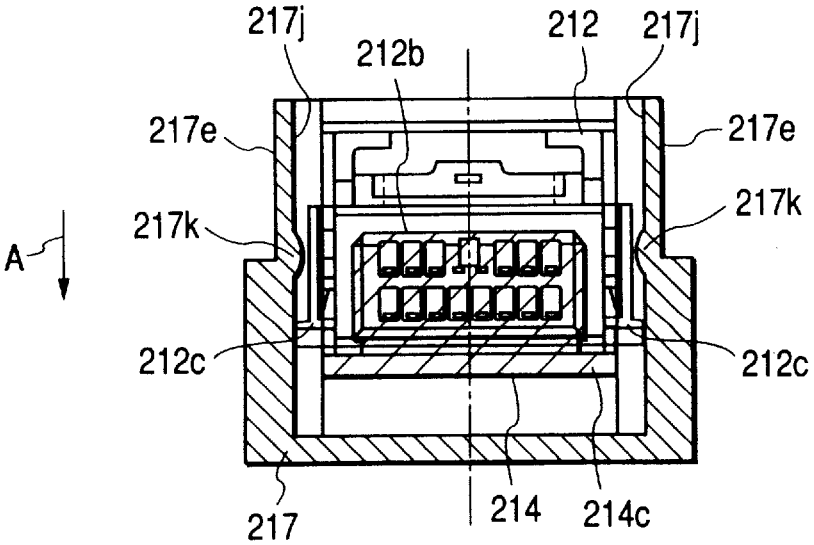

The hold guide protuberance 212*d* of the engagement section 212*b* of the male connector 212 sits astride and runs on the hold guide rail 214*d* of the engagement section 214*a* of the male connector 214. Finally, the hold guide protuberance 212*d* is engaged with the lower end of the hold guide rail 214*d*. The male connector 212 is sustained (or locked) by the female connector 214 so as not to move in an engagement direction (in the direction in which the male connector 212 is to be engaged with the female connector 214). The inner upper surface 212*e* of the engagement section 212*b* of the male connector 212 remains in contact with the upper surface 212*e* of the engagement section 214*a* of the female connector 214 (see FIGS. 19A and 19B).

When the overhead module 201 is caused to approach the roof panel 203 (in the direction designated by arrdw A), the guide pins 214*b* of the female connector 214 are moved laterally in a forward direction F while being guided by the cam slots 217*g* and 217*f* of the female holder 217. In association with approach of the overhead module 201 (designated by arrow A), the engagement section 212*b* of the male connector 212 is engaged with the engagement section 214*a* of the female connector 214, wherewith terminals of the engagement section 214*a* of the female connector 214 are engaged with terminals of the engagement section 212 of the male connector 212.

At the time of lateral movement of the female connector 214 in forward direction F, the hold guide protuberance 212*d* of the engagement section 212*b* of the male connector 212 is engaged with the lower end of the hold guide rail 214*d* of the engagement section 214*a*. However, lateral movement of the female connector 214 in forward direction F is allowed, and the inner upper surface 212*e* of the engagement section 212*b* of the male connector 212 is in contact with the upper surface 214*e* of the engagement section 214*a* of the female connector 214. The lateral movement of the female connector 214 in forward direction F is guided by the hold guide protuberance 212*d* and the inner upper surface 212*e* of the male connector 212 until the male connector 212 is completely coupled with the female connector 214.

Figure 20:
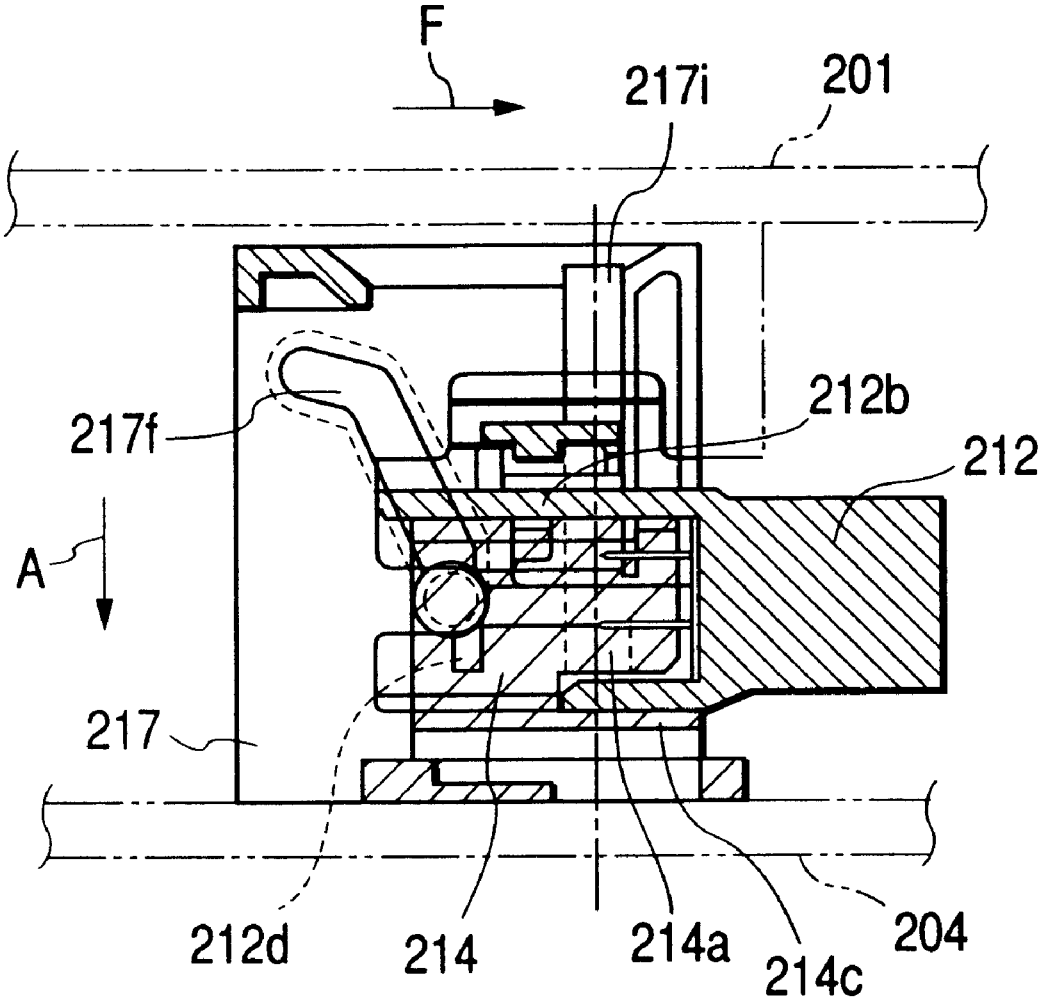
FIG. 20 is a cross-sectional view showing connectors which have been coupled.

As shown in FIG. 20, when the overhead module 201 is caused to approach the roof panel 203 further (in the direction designated by arrow A), the female connector 214 is further moved laterally in forward direction F. The engagement section 212*b* of the male connector 212 is deeply engaged with the engagement section 214*a* of the female connector 214. Terminals of the engagement section 214*a* of the female connector 214 are completely coupled with terminals of the engagement section 212*b* of the male connector 212. Connection of the male connector 212 to the female connector 214 is now completed.

As mentioned above, if the overhead module 201 is caused to approach the roof panel 203, the engagement section 214*a* of the female connector 214 is connected to the engagement section 212*b* of the male connector 212 while being moved laterally in forward direction F. Thus, connection of the female connector 214 to the male connector 212 is completed. The male connector 212 and the female connector 214 remain in a lateral orientation before and after connection. Therefore, there is obviated a necessity for ensuring a wide connector coupling space between the roof panel 203 and the overhead module 201 (in a depthwise direction). Therefore, even in a case where only a narrow space is ensured in a depthwise direction, connectors can be coupled.

When the overhead module 201 is caused to approach the roof panel 203, terminals of the engagement section 212*b* of the male connector 212 are completely coupled with terminals of the engagement section 214*a* of the female connector 214 before the male connector 212 is completely connected to the female connector 214. Subsequently, connection of the engagement section 212*b* of the male connector 212 to the engagement section 214*a* of the female connector 214 is completed while the engagement section 212*b* and the engagement section 214*a* remain in a lateral orientation. Terminals of the engagement section 212*b* and terminals of the engagement section 214*a* are completely connected together before connection of the male connector 212 to the female connector 214 is completed. Depthwise dimensional errors between the roof panel 203 and the overhead module 201 are absorbed, and hence the dimensional tolerance of the connectors 212 and 214 to depthwise errors is improved. Since terminals of the engagement section 212*b* are completely coupled to terminals of the engagement section 214*a* before connection of the male connector 212 to the female connector 214 is completed. Hence, the chance of incomplete connection of the male connector 212 to the female connector 214 (i.e., a connection failure) can be eliminated.

Since the male connector 212 of the overhead module 201 is fixed on the stationary base 215 so as to be able to oscillate. In the event that a certain amount of positional error arises between the male connector 212 of the overhead module 201 and the female connector 214 of the roof panel 203 in terms of assembly, oscillating action of the male connector 212 provides versatility of positional adjustment during assembly. Accordingly, the male connector 212 can be smoothly connected to the female connector 214 without a hitch.

At the time of the female holder 217 being connected to the mount 204 of the roof panel 203, the hooks 205 of the mount 204 are inserted into the corresponding hook insert holes 217*b* of the female holder 217. The female holder 217 is slid, wherewith the hooks 205 are engaged with the hook engagement sections 217*c*. Thus, the female holder 217 can be attached to the roof panel 203 with a single motion. Accordingly, the ease of assembly of connectors is enhanced. Attachment of the female holder 217 to the mount 204 while the female holder 217 is oriented in an incorrect direction is detected by the detection means 207. Therefore, the female holder 217 is attached to the mount 204 at all times while being oriented in a predetermined direction.

In this case, after attachment of the female holder 217 to the roof panel 203, the female connector 214 having a harness connected thereto may be attached to the female holder 217 mounted on the roof panel 203. However, in this case, slack in the harness of the female connector 214 ensured for assembly purpose becomes longer. In the present embodiment, a harness is connected to the female connector 214, and the female connector 214 having the harness attached thereto is connected to the female holder 217. Subsequently, the female holder 217 having the female connector 214 connected thereto is fixed on the roof panel 203. As a result, slack in the harness ensured for assembly purpose becomes shorter, thus resulting in cost reduction. Further, there is prevented occurrence of unusual noise, which would otherwise be caused by slack, and there is reduced a possibility that electric wires could be caught during assembly of panels.

In the present embodiment, the hooks 205 are formed in the mount 204, and the hook insert holes 217*b* and the hook engagement sections 217*c* are formed in the female holder 217. In contrast with this embodiment, the present invention may be embodied by employment of configurations shown in FIGS. 22 through 25B. More specifically, hook insert holes 221 and hook engagement sections 222 may be formed in a mount 220, and hooks 231 may be formed in a female holder 230. In the present embodiment, the detection means 207 is formed in the mount 204 so as to protrude upward toward the female holder 217. In contrast with the embodiment, the present invention may be embodied preferably in the configurations shown in FIGS. 22 through 25B. More specifically, detection means 233 is preferably formed in the female holder 230 so as to protrude downward toward the mount 220.

Such a connector configuration will be described specifically.

As shown in FIGS. 22 through 25B, the female holder 230 has a square box shape, and the top of the female holder 230 is open. An opening is formed in the front and back surfaces of the female holder 230. A pair of hooks 231 serving as engagement sections are formed in a bottom surface 230*a* of the female holder 230. Each hook 231 has a raised section 231*a* and a horizontal section 231*b*. The raised section 231*a* has an L-shaped geometry. A shorter portion of the raised section 231*a* extends outward in the direction orthogonal to a direction designated by arrow H (hereinafter referred to as a "direction H"), and a longitudinal portion of the raised section 231*a* extends in the direction opposite the direction H. The end of the raised section 231*a* in the direction H projects from the end of the horizontal section 231*b* in the direction H, to thereby constitute a projection 231*c*. The projection 231*c* of the raised section 231*a* has the function of preventing attachment of the female holder 230 while the female holder 230 is directed in an incorrect orientation. The end of the L-shaped raised section 231*a* opposite the direction H acts as a stopper.

A lock section 232 is formed in the area between the pair of hooks 231. As shown in FIGS. 23 through 25B, the lock section 232 has a protuberance 232*a* formed in the shape of a tongue. Specifically, the longitudinal sides of the protuberance 232*a* are cut, and the longitudinal end 232*a* in the direction opposite the direction H is also cut. The protuberance 232*a* has a downwardly-protruding bulge. Detection means 233 for detecting attachment of the female holder 230 while the female holder 230 is directed in an incorrect orientation is provided at the end on the bottom of the female holder 230 in the direction opposite the direction H. The detection means 233 is formed so as to protrude downward.

The mount 220 which constitutes a part of the roof panel 203 (not shown) is mounted on the interior surface (i.e., shown in a lower portion of the drawing) by way of an unillustrated support member while a narrow clearance is ensured between the roof panel 203 and the mount 220. A pair of hook insert holes 21 are formed in the mount 220, and hook engagement sections 222 are formed in the mount 220 so as to communicate with the respective hook insert holes 221. A lock hole 223 for locking the projection 232*a* is formed in the mount 220. A receiving hole 224 is also formed in the mount 220 next to the lock hole 223 in the direction opposite the direction H. Further, an opening hole 225 into which the detection means 233 is to be inserted is formed in the mount 220. The hook insert hole 221 is formed so become slightly larger than the horizontal section 231*b*, so that the horizontal section 231*b* of the hook 231 can readily enter the hook insert hole 221.

Procedures for attaching the female holder 220 to the mount 220 will now be described.

Figure 23A:
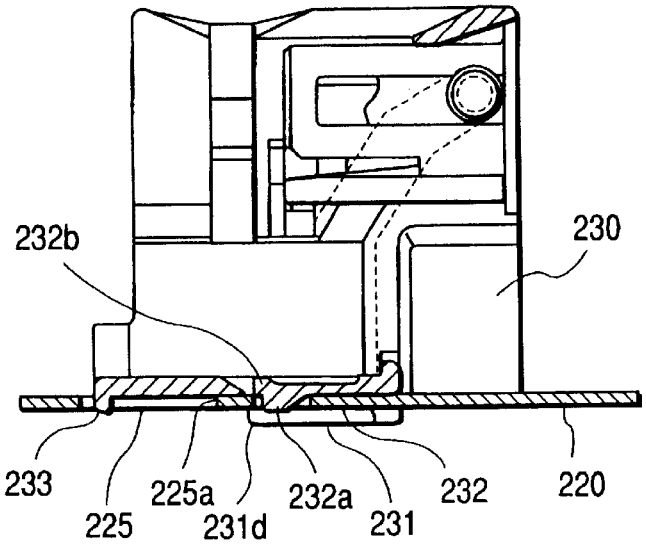
FIG. 23A is a front cross-sectional view showing a female holder before the holder is attached to the mount according to the second embodiment (taken along line J—J shown in FIG. 23B).
Figure 23B:
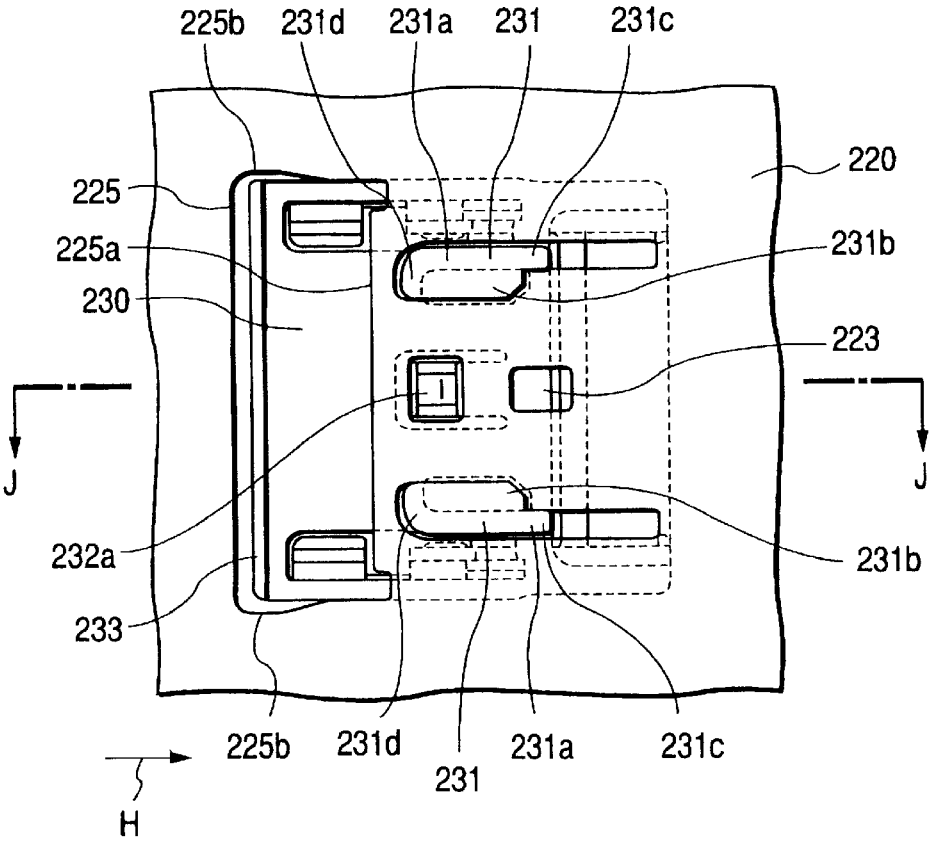
FIG. 23B is a bottom view showing the female holder.

As shown in FIGS. 23A and 23B, the female holder 230 is caused to approach the mount 220, and the hooks 231 are inserted into the hook insert holes 221. The female holder 230 can be attached to the mount 220 in only a direction in which the detection means 22 is inserted into the opening hole 225. In a case where the female holder 230 is directed in this orientation, the projection 231*c* of the hook 231 is inserted into the groove of the hook engagement section 222. In contrary, in a case where the female holder 230 is directed in an incorrect orientation, insertion of the projection 231*c* of the hook 231 is blocked by the hook insert hole 221. The projection 231*c* also contributes to prevention of attachment of the female holder 230 while the female holder 230 is directed in an incorrect orientation. As a result of insertion of the projection 231*c* being blocked, the operator becomes aware that he is attempting to attach the female holder 230 in an incorrect orientation. Therefore, the operator will attach the female holder 230 by means of changing the orientation of the female holder 230.

In a state in which the detection means 233 is fitted into the opening hole 225, movement of each end of the detection means 233 is limited by a side section 225*b* of the opening hole 225, thereby preventing rotation of the female holder 230 relative to the mount 220. The hooks 231 are inserted into the hook insert holes 221 and portions of the hook engagement sections 222 (the portions of the hook engagement sections 222 adjoining the hook insert holes 221). Further, the protuberance 232*a* of the lock section 232 is inserted into the receiving hole 224. The sides 225*b* of the opening hole 225 are tapered such that the distance between the sides 225*b* becomes longer in the direction opposite to the direction H and becomes shorter in the direction H. The wide portion of the opening hole 225 is intended for facilitating insertion of the detection means 233 into the opening hole 225. Further, a narrow portion of the opening hole 225 is formed so that the sides 225*b* of the opening hole 225 can guide the detection means 233 to a predetermined position at the time of sliding of the female holder 230, which will be described later.

Figure 24A:
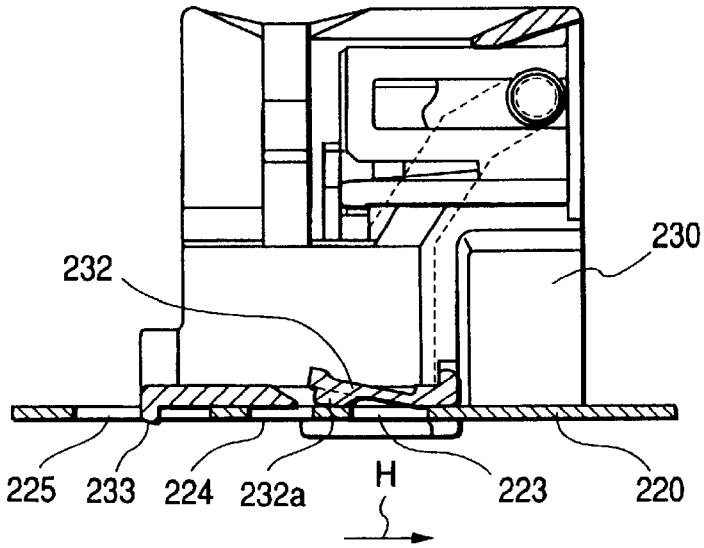
FIG. 24A is a front cross-sectional view showing a state in which a female holder is slid relative to a mount according to the second embodiment (taken along line K—K shown in FIG. 24B).
Figure 24B:
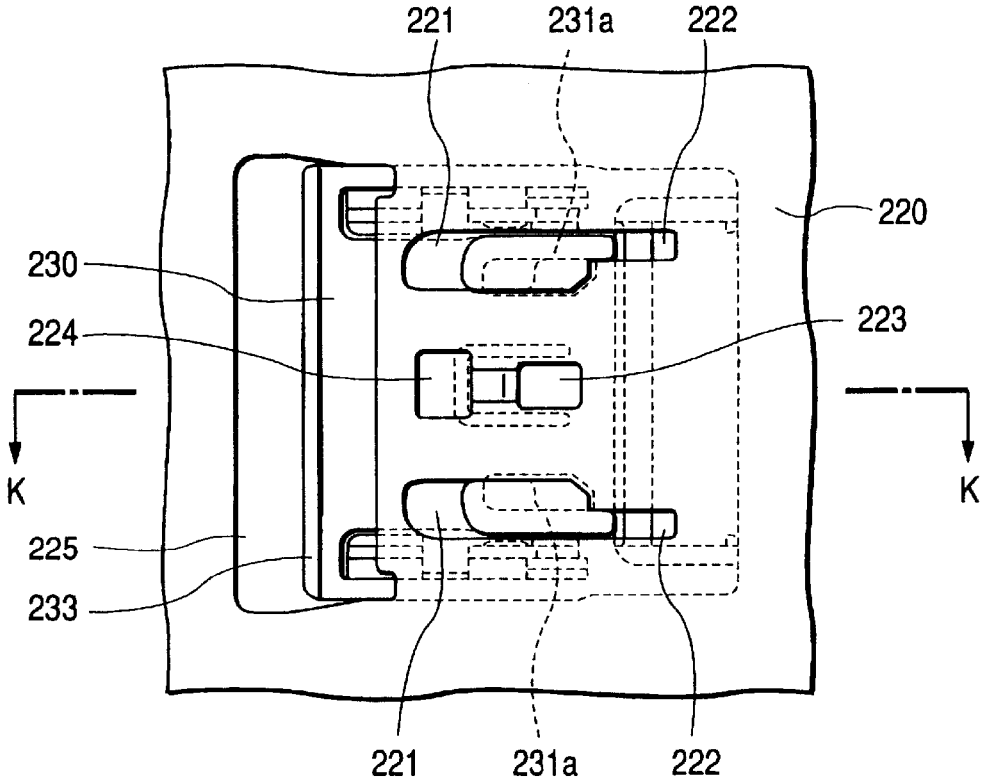
FIG. 24B is a bottom view showing the same.
Figure 25A:
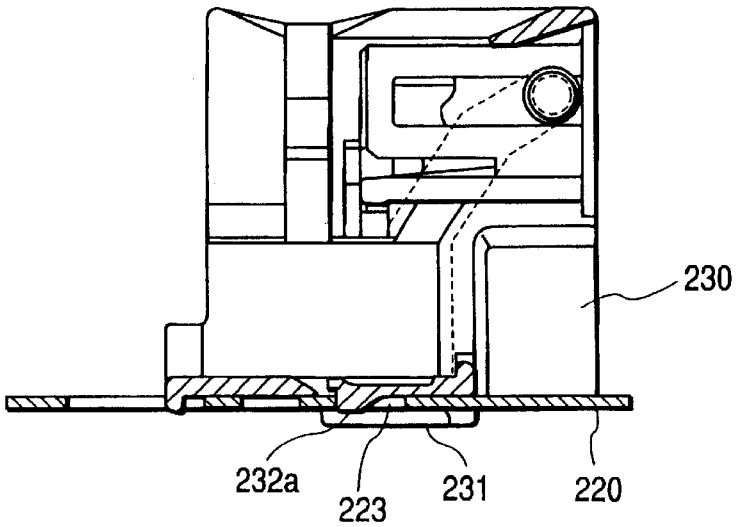
FIG. 25A is a front cross-sectional view showing a female holder which is attached to a mount according to the present embodiment (taken along line L—L shown in FIG. 25B)
Figure 25B:
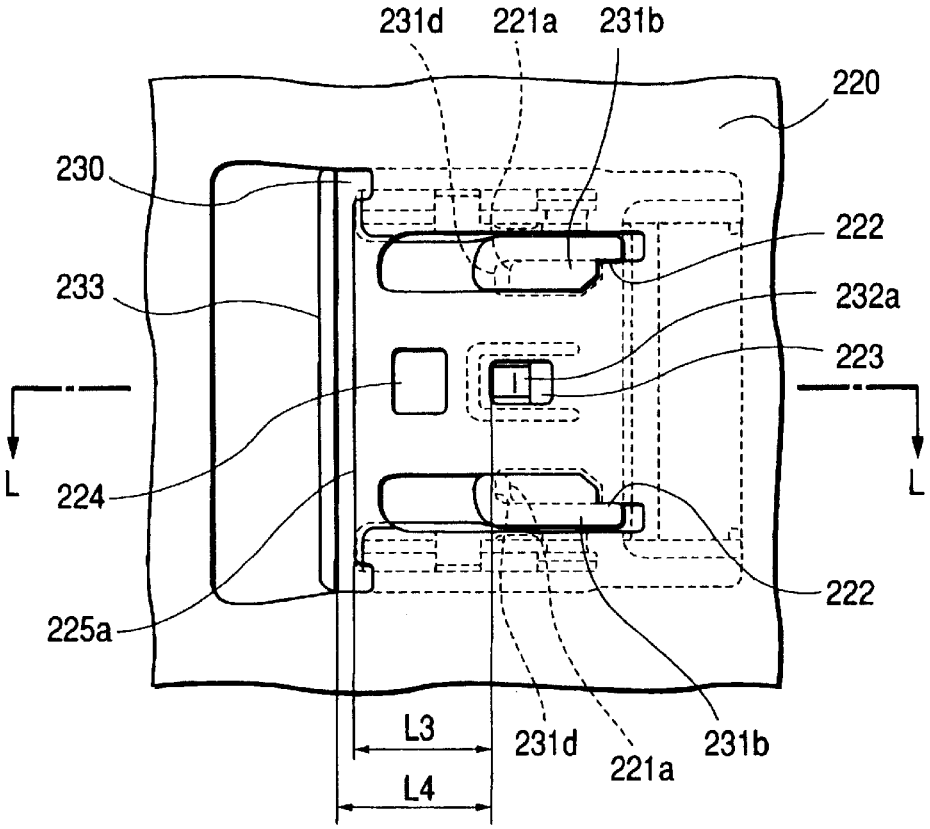
FIG. 25B is a bottom view.
Figure 26A:
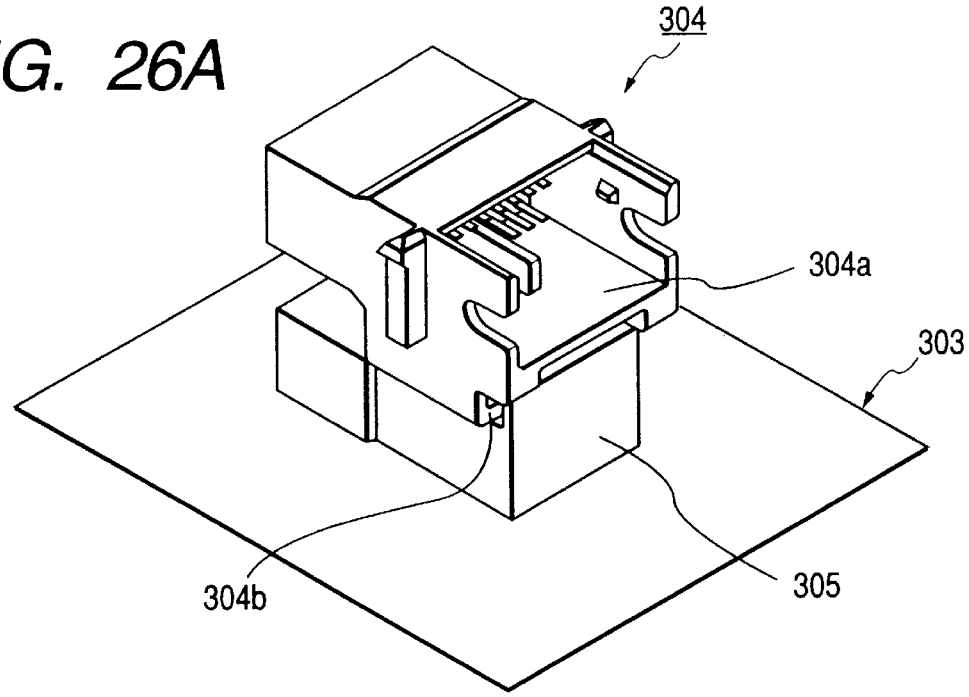
Figure 26B:
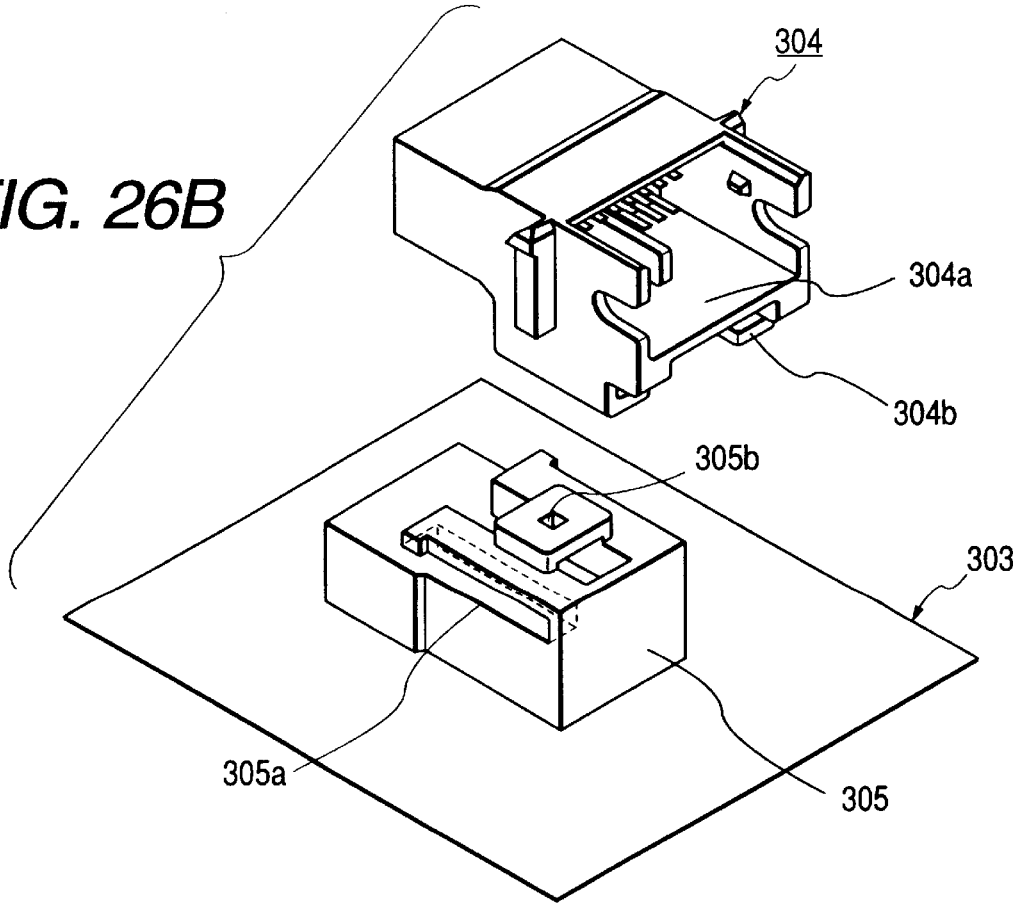
Figure 27A:
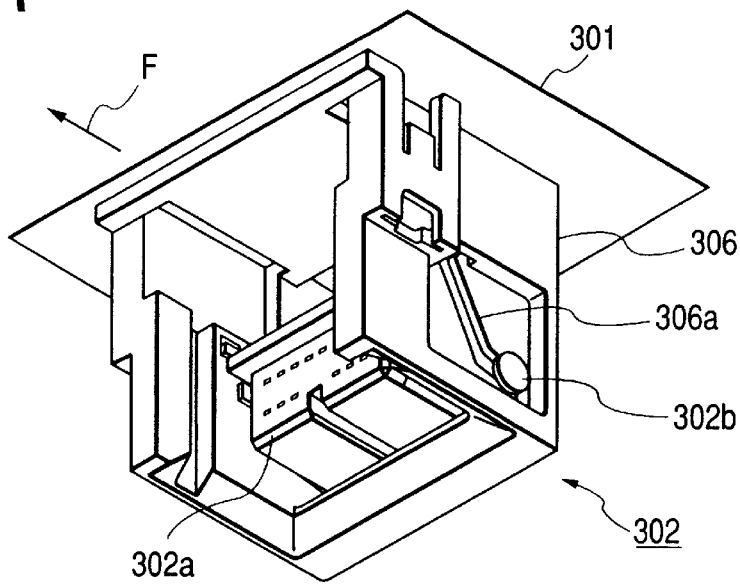
FIG. 27A is a perspective view showing assembly of a connector and a holder.
Figure 27B:
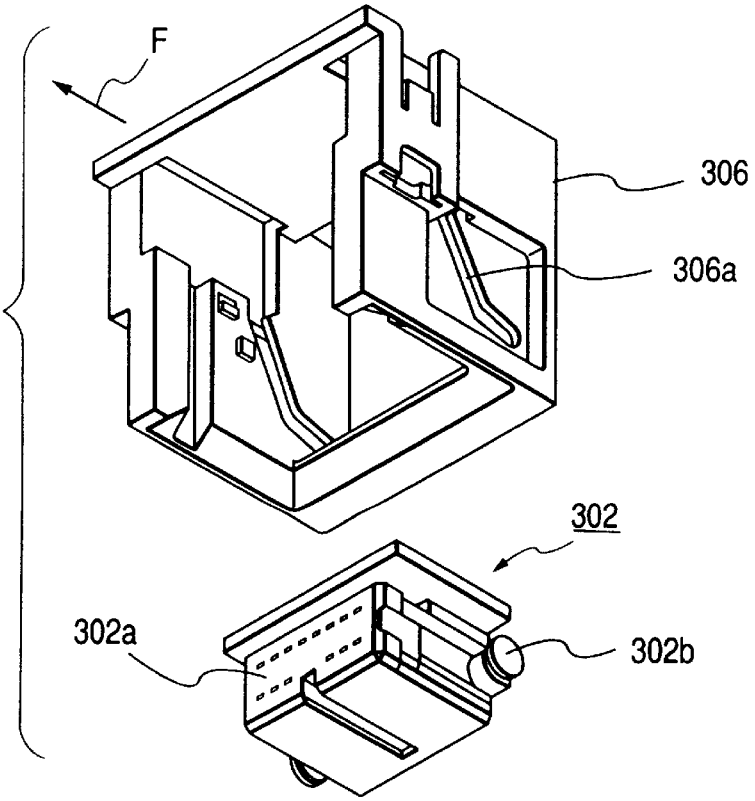
FIG. 27B is an exploded perspective view of the same shown in FIG. 27A.
Figure 28A:
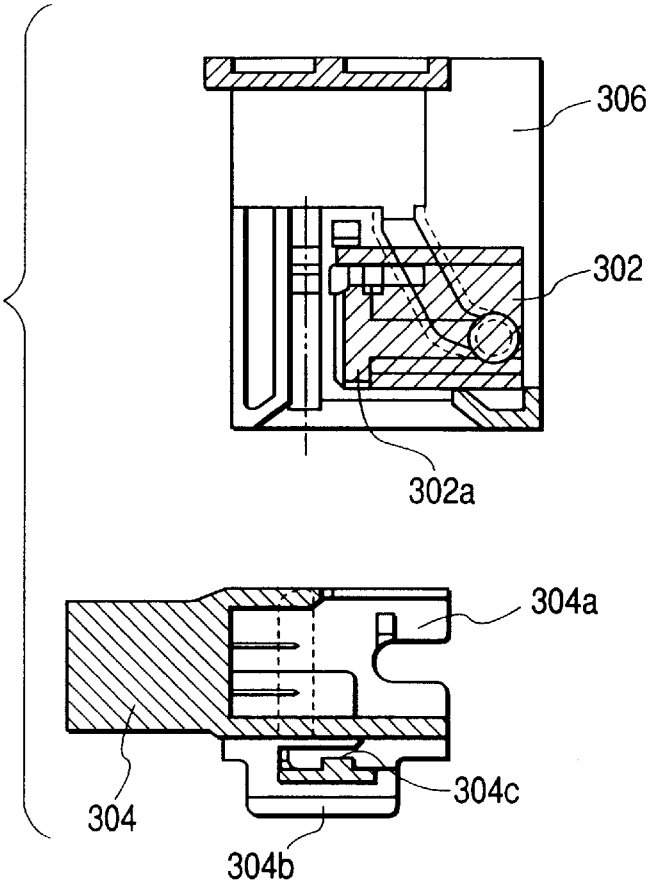
Figure 28B:
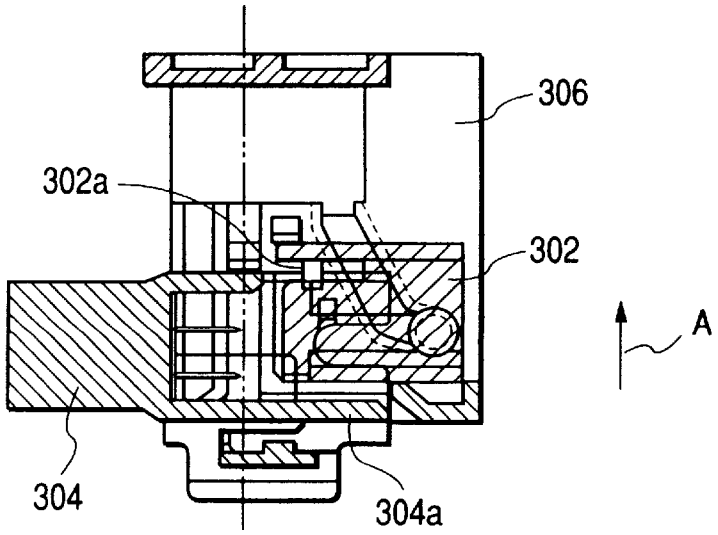
Figure 29A:
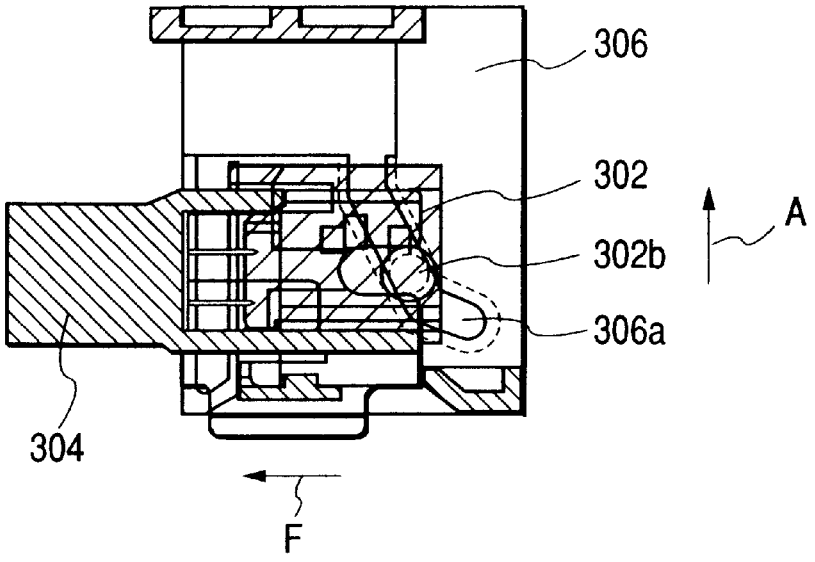
Figure 29B:
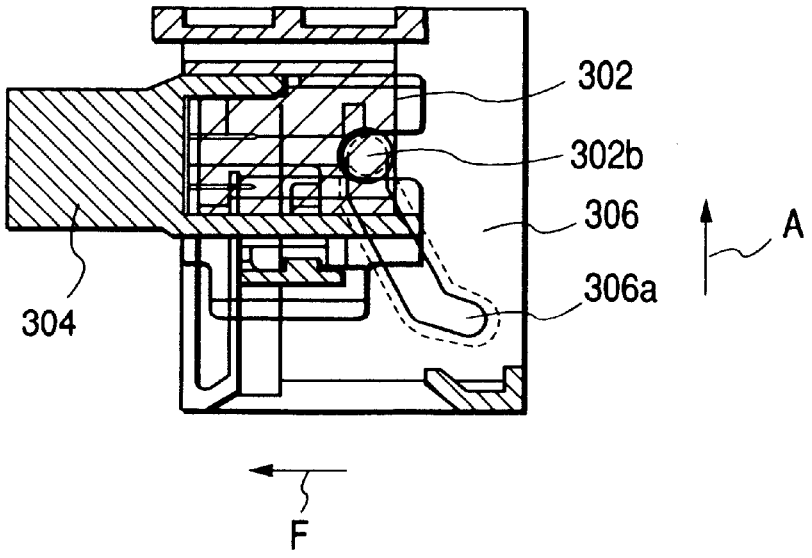

After having been set in a pre-mounting state, the female holder 230 is slid in the direction H (forward direction), as shown in FIGS. 24A and 24B. As a result, the raised section 231*a* passes through the groove of the hook engagement section 222, and the protuberance 232*a* of the lock section 232 sits on and runs on the area between the receiving hole 224 and the lock hole 223. As shown in FIGS. 25A and 25B, the horizontal section 231*b* of the hook 231 is engaged with the hook engagement section 222, and the protuberance 232*a* is inserted into and locked by the lockhole 223. An end portion 231*d* of the L-shaped raised section 231*a*—which is located at the longitudinal end of the L-shaped raised section 231*a* in the direction opposite the direction H—is brought into contact with or is in a state immediately before coming in contact with the hook insert hole 221 and a step section 221*a* of the hook engagement section 222. As a result, the female holder 230 is attached to the mount 220. The receiving hole 224 and the lock hole 223 are not limited to through holes but may be recessed.

As shown in FIGS. 25A and 25B, distance L3 between the end face 225*a* and the lock hole 223 is set to become shorter than distance L4 between the detection means 233 and the protuberance 232*a*. Even in a state in which the protuberance 232*a* is locked in the lock hole 223, the female holder 230 can move in the direction H relative to the mount 220 over only a distance corresponding to the distance between L3 and L4. In other words, the female holder 230 has play relative to the mount 220. Therefore, in the event of positional displacements arising between the overhead module 201 and the stationary base 215, between the stationary base 215 and the male connector 212, between the female connector 214 and the male connector 212 before coupling, or between the female connector 214 and the female holder 220, the positional displacements can be absorbed.

As shown in FIGS. 23A and 23B, a pulling tool (not shown) whose tip end is formed into a hook is engaged with a recess 232*b* (lock release means) formed in the end of the lock section 232. The recess 232*b* is pulled upward, to thereby release the protuberance 232*a* from the lock hole 223. The lock release means 232*b* may be embodied by means of causing a portion of the surrounding area of the lock hole 223 of the mount 220 to extend to a location below the protuberance 232*a*, and the thus-extended portion may be pulled upward through use of a similar pulling tool.

Figure 22:
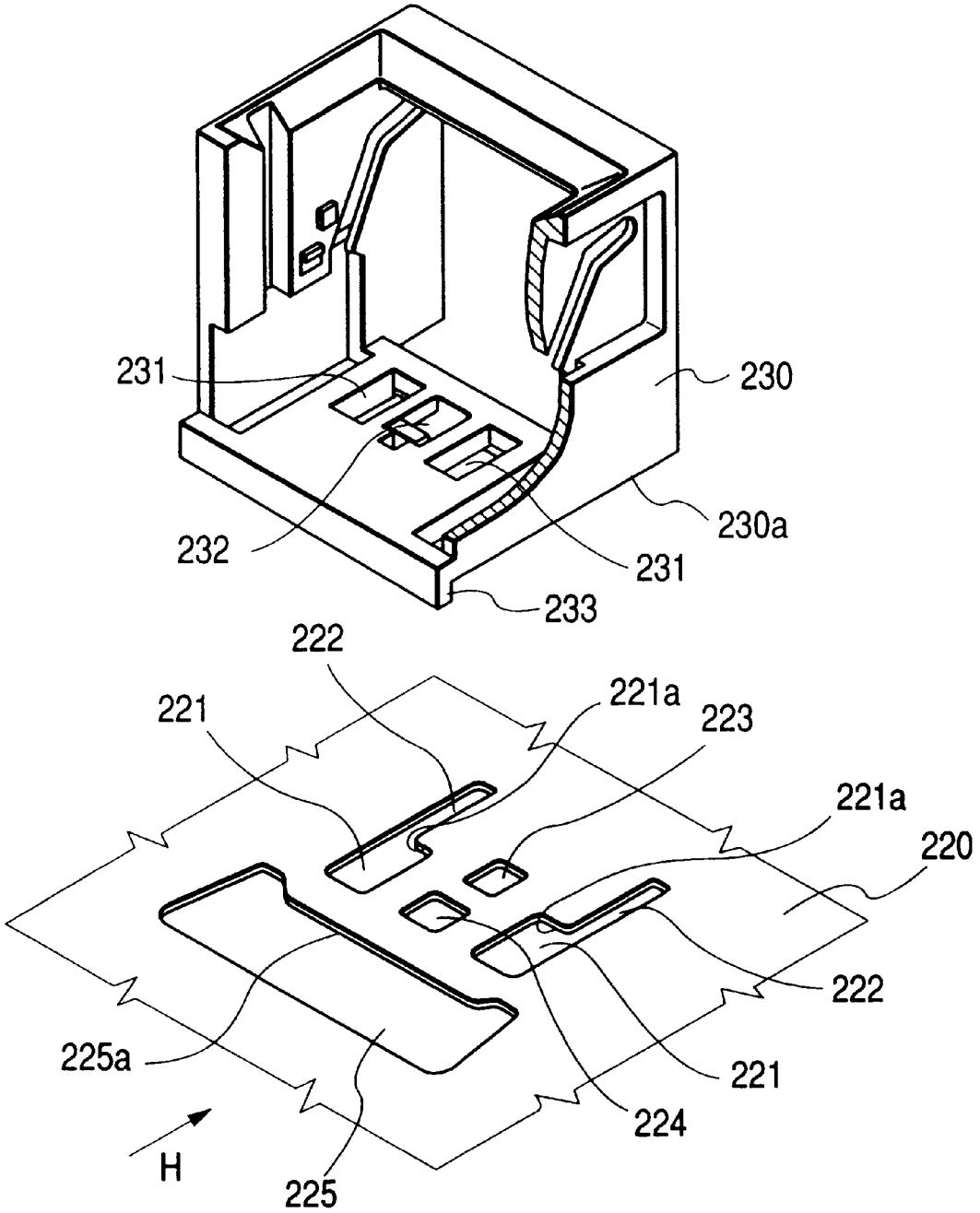
FIG. 22 is an exploded perspective view showing a mount and a female holder according to a second embodiment of the present invention.

In the connector construction shown in FIGS. 22 through 22B, engagement-receiving sections, each comprising a hook insert hole and a hook engagement section, can be formed in a second mount member by means of forming holes in the second mount member. A holder has engagement sections and accordingly has a complicated constitution. Since the holder is usually formed by means of molding through use of molds, the only requirement is modification of the design of molds, which does not pose any problem in manufacture of a holder. A holder manufactured through use of molds is usually provided with detection means for detecting attachment of the holder while the holder is directed in an incorrect orientation. Therefore, even in the case of a holder construction being complicated, the only requirement is modification of the design of molds, which does not pose any problem in manufacture of a holder. When a hole for receiving projecting detection means is formed in the second mount, the hole can be embodied by means of drilling the second mount, which does not involve any difficulty in machining.

In the embodiments, hooks are provided as engagement sections, and hook insert holes and hook engagement sections are provided as engagement-receiving sections. The present invention is not limited to such a connector construction; any connector construction can be employed, so long as the construction enables engagement of connectors by means of sliding action.

The embodiment are directed toward attachment of the overhead module 201 (such as a lamp) to the roof panel 203, but the present invention is not limited to these embodiments. Needless to say, the present invention can be applied to a door module or a center cluster module.

As mentioned above, the present invention provides the connector comprising:

a first connector mounted on a first mount, and a second connector mounted on a second mount, in which, when the first and second mounts are caused to approach each other, the first connector is connected to the second connector, the connector comprising:

an insufficient insertion prevention structure for pushing a terminal engagement member in an insufficiently-inserted state to a predetermined position in a housing of the connector by means of a press protuberance of a holder when the first and second mounts are caused to move relatively. Accordingly, the connector can prevent the terminal engagement member for locking an electrode terminal from entering an insufficiently-inserted state. Thus, the electrode terminal can be locked in a housing without fail.

Further, the present invention can be applied to a connector which couples a second connector to a first connector while being directed laterally and deflecting in a forward direction. Therefore, there is achieved the same working-effect as that mentioned previously.

The present invention can be applied to a connector which connects a first connector to a first mount. When the first connector and the first mount are caused to approach each other, the insufficient insertion prevention structure pushes a terminal engagement member in an insufficiently-inserted state to a predetermined position in the housing of the first connector. Accordingly, there is achieved the same working-effect as that mentioned previously.

As is evident from the foregoing descriptions, according to the connector of the present invention, a lock section of a support base is inserted into a clearance between a lower surface of a first connector and an upper surface of a lock piece section, wherewith a lock claw of the lock piece section is engaged with a lock hole formed in the lock section. As a result, a first connector is supported by the support base, and the lock piece section provided in the middle of a U-shaped spring is supported by the lock section of the support base. Accordingly, the first connector is supported so as to be able to deflect in any of the vertical, horizontal, and back/forth directions while both ends of the U-shaped spring are taken as fulcrums.

When the first and second connectors are engaged with each other, the first connector has a self-alignment function of deflecting with respect to the second connector in any of the vertical, horizontal, and back/forth directions. Therefore, the first connector can be readily engaged with the second connector.

The connector is configured such that the lock claw of the lock piece section of the first connector is engaged from below with the lock hole of the lock section of the support base when shoes of the first connector are inserted into shoe grooves formed in the support base. As a result, the first connector can be quickly supported by the support base with a single operation.

The regulation projection of the first connector is loosely engaged with the lock hole of the lock section of the support base, wherewith displacement of the first connector is regulated. If an operator erroneously and forcefully pulls electric wires of the first connector, the U-shaped spring section may be extended and broken. However, the regulation projection of the first connector is brought into contact with the interior wall surfaces of the recess, wherewith displacement of the first connector is regulated. Thus, there is prevented fracture of the U-shaped spring section, which would otherwise be caused when the same is extended undesirably.

The regulation projection of the lock piece section of the first connector is loosely engaged with the recess of the first connector, thereby regulating displacement of the first connector. As a result, there can be yielded working-effects which are the same as those achieved previously.

As is evident from the foregoing description, in the connector construction according to the present invention, when a holder is slid in the longitudinal direction of a second mount member, engagement sections are engaged with engagement-receiving sections. Further, a lock section is engaged with a lock-receiving section. Thus, the holder can be attached to the second mount with a single operation, thus improving the ease of assembly of connectors. A first connector is mounted on a first mount member while being directed in a lateral orientation. A holder of the second mount member supports a second connector laterally so that the second connector can oscillate in a forward direction. When the first and second mount members are caused to approach each other, the second connector is connected to the first connector while being oriented laterally and oscillating in a forward direction. Since the first and second connectors remain oriented laterally before and after connection, there is obviated a necessity for ensuring a wide connector coupling space between connectors (in the depthwise direction thereof). Accordingly, connectors can be coupled even in the case of only a narrow space being ensured in a depthwise direction of connectors. A harness is connected to the second connector, and the second connector having the harness attached thereto is attached to a holder. The holder having the second connector attached thereto is mounted on the second mount member. In contrast with a case where, after a holder has been mounted on the second mount member, the holder mounted on the second mount member is connected to the second connector having a harness connected thereto, slack in the harness can be shortened, which in turn results in cost reduction. Further, occurrence of unusual noise, which would otherwise be caused by slack, can be eliminated, and a possibility that electric wires could be caught during assembly of panels can be reduced.

Engagement sections, each comprising a hook, are formed in a holder, and engagement-receiving sections, each comprising a hook insert hole and a hook engagement section, are formed in the second mount member. The engagement-receiving sections can be formed in the second mount member by means of drilling the second mount member. Further, a holder which is usually formed through use of molds can be produced through mere modification of the design of molds, thus posing no problem in manufacture of a holder.

In a case where a projection is formed in a hook, the presence of the projection blocks insertion of the hook into a hook insert hole even when an attempt is made to insert the hook in the hook insert hole while the hook is directed in an incorrect orientation. Therefore, the projection can prevent attachment of the holder while the holder is directed in an incorrect orientation.

If the connector construction is provided with lock release means, the holder can be readily disengaged from the second mount member.

If the connector construction is provided with detection means for detecting attachment of a holder while the holder is directed in an incorrect orientation, the holder can be attached to the second mount member in a given direction. The detection means is convenient in a case where an engagement section is engaged with an engagement-receiving section in a specific orientation.

The detection means is formed in the holder so as to protrude toward the second mount member. A holder usually formed through use of molds is provided with the detection means Therefore, even in a case where the structure of the holder becomes complicated, the only requirement is modification of the design of molds, thus posing no problem in manufacture of a holder. Further, an opening hole for receiving projecting detection means is formed in the second mount member, and can be made by means of only drilling the second mount member, thus involving no problems in the ease of machining. These advantages are particularly beneficial at the time of combination of some of the above-described connector constructions.

In a case where the first mount member corresponds to a stationary panel of a car body and the second mount member corresponds to a movable panel of an electrical module, the present invention obviates a necessity of manual connection of connectors during assembly processes of an automobile. Therefore, occurrence of unusual noise, which would otherwise be caused by slack, can be prevented, and a possibility that electric wires could be caught during assembly of panels is reduced. Hence, various countermeasures, which have conventionally been taken for preventing such problems, can be obviated. Further, since connectors can be connected even when only a narrow depthwise space is ensured between a panel of a car body and a panel of an electrical module, the interior room of a car can be increased correspondingly.

What is claimed is:

1. A connector comprising:

a support base mounted on a first mount member;

a first connector oriented laterally and supported by the support base to be able to deflect in any of the vertical, horizontal, and back/forth directions;

a holder mounted on a second mount member; and a second connector which is supported by the holder while being oriented laterally and can be deflected in a forward direction, wherein when the first and second mount members are caused to approach each other, the second connector is coupled to the first connector while being deflected in a forward direction and oriented laterally, a lock section formed on the support base and having a lock hole formed therein;

a spring section formed in a lower portion of the first connector, the spring section connected at both ends to the first connector, the spring section having a U-shaped shape form when viewed from the top; and a lock piece section having a lock claw and being formed in the middle of the U-shaped spring section, wherein, when the lock section of the support base is inserted into a clearance between the lower surface of the first connector and the upper surface of the lock piece section, the lock claw of the lock piece section is engaged with the lock hole of the lock section, whereby the first connector is supported to be able to deflect while both ends of the U-shaped spring section are taken as fulcrums.

2. The first connector as defined in claim 1, wherein insert shoe grooves are formed in an upper portion of the support base; insert shoes are formed in a lower portion of the first connector; and, when the shoes of the first connector are inserted into the shoe grooves of the support base, the lock claw of the lock piece of the first connector is engaged with the lock hole of the lock section.

3. The first connector as defined in claim 1, wherein a recess is formed in the upper surface of the lock section of the support base; a regulation projection is formed on the lower surface of the first connector, in which, when the lock claw of the lock piece section of the first connector is engaged from below with the lock hole of the lock section of the support base, the regulation projection is loosely engaged from above with the recess; and the regulation projection is brought into contact with the interior wall surfaces of the recess, thereby regulating displacement of the first connector.

4. The first connector as defined in claim 1, wherein a recess is formed in the lower surface of the first connector; a regulation projection is formed on the upper surface of the lock piece section of the first connector, in which, when the lock claw of the lock piece section of the first connector is engaged from below with the lock hole of the lock section of the support base, the regulation projection is loosely engaged from below with the recess; and the regulation projection is brought into contact with the interior wall surfaces of the recess, thereby regulating displacement of the first connector.

5. The connector as defined in claim 1, wherein the first and second mount members correspond to a stationary panel of a car body and an electrical module.

* * * * *